US005766835A

United States Patent [19]

Matsunaga

[11] Patent Number: 5,766,835

[45] Date of Patent: Jun. 16, 1998

[54] SILVER HALIDE PHOTOGRAPHIC LIGHT-SENSITIVE MATERIAL

[75] Inventor: Naohiro Matsunaga, Minami-ashigara, Japan

[73] Assignee: Fuji Photo Film Co., Ltd., Kanagawa, Japan

[21] Appl. No.: 718,243

[22] Filed: Sep. 20, 1996

[30] Foreign Application Priority Data

Sep. 22, 1995 [JP] Japan ..... 7-268091

[51] Int. Cl.[6] ..... G03C 1/89

[52] U.S. Cl. ..... 430/523; 430/527; 430/531; 430/532; 430/533; 430/537; 430/621; 430/631

[58] Field of Search ..... 430/53, 527, 531, 430/532, 533, 537, 621, 631

[56] References Cited

U.S. PATENT DOCUMENTS

| | | | |
|---|---|---|---|
| 5,238,794 | 8/1993 | Hirose et al. | 430/504 |
| 5,336,589 | 8/1994 | Mukunoki et al. | 430/501 |
| 5,558,977 | 9/1996 | DePalma et al. | 430/523 |
| 5,565,311 | 10/1996 | Kawamoto | 430/523 |

FOREIGN PATENT DOCUMENTS 6-59357 4/1994 Japan .

*Primary Examiner*—Hoa Van Le

*Attorney, Agent, or Firm*—Sughrue, Mion, Zinn, Macpeak & Seas, PLLC

[57] ABSTRACT

There is disclosed a silver halide photographic light-sensitive material that comprises at least one backing layer on a support, wherein at least one of the backing layers contains a crosslinking agent of the general formula (1) in the range of from 3 to 1000 mg/m$^2$, and at least one of the backing layers is a transparent magnetic recording layer containing abrasives that have Moh's hardness values of not less than 5.

General formula (1)

wherein n is an integer of $n \geqq 0$; m is an integer of 1 or 2; and $R_1$, $R_2$, and $R_3$ each represent a hydrogen atom, an alkyl group, or an aryl group. In the light-sensitive material, the problem of emulsion peeling on the side of the back surface is hardly to arise, and in addition, an error in magnetic recording/reproducing caused after development processing is also hardly to cause.

16 Claims, No Drawings

SILVER HALIDE PHOTOGRAPHIC LIGHT-SENSITIVE MATERIAL

FIELD OF THE INVENTION

The present invention relates to a silver halide photographic light-sensitive material (hereinafter referred to as "a photographic light-sensitive material," "a light-sensitive material," "a photographic material," or "a photographic film," according to the occasion) having a transparent magnetic recording layer.

BACKGROUND OF THE INVENTION

JP-A ("JP-A" means unexamined published Japanese patent application) No. 59357/1994 discloses a light-sensitive material that has a transparent magnetic recording layer containing an isocyanate compound.

Generally, photographic light-sensitive materials are often seriously adversely affected by contact friction with various devices, machines, cameras, etc., or by contact friction with extraneous matter, such as dust and flock, not only during the process of production, including coating, drying, and other processing, but also at handling related to winding, rewinding, or conveyance of the light-sensitive material, when the same is subjected to photographing, processing (development), printing, projection, etc. In particular, the back surface side has frequent opportunities to directly contact various machine parts. Consequently, such serious problems as emulsion peeling (emulsion loosening) tend to arise. Such emulsion peeling is a serious practical problem, since the plural emulsion peelings appear to overlap each other on the surface of an image at printing or projection. Further, recently light-sensitive materials are subjected to harsher handling than in the past, owing to expanded usages and processing methods of light-sensitive material, as exemplified by high-speed coating, quick filming, and rapid processing, and also to use-related environmental diversification, such as at high temperature and high humidity. Consequently, such problems arise more easily nowadays. Accordingly, there is need for the development of a light-sensitive material having a back layer (a backing layer) whose durability is high so that emulsion peeling is not caused even under such harsh conditions.

On the other hand, for a light-sensitive material having a magnetic recording layer, the said magnetic recording layer is also applied to the back surface of the light-sensitive material, which results in high probability of not only contact friction with a magnetic head, but also the occurrence of emulsion peeling. Consequently, if the magnetic recording layer also has poor durability (i.e. if emulsion peeling and the like occur), a defect of the photographic film occurs, and furthermore the serious problem of disappearance of magnetic information arises. Preferably the magnetic recording layer is an outermost backing layer or a layer adjacent to the outermost layer, from the viewpoint that loss of magnetic output due to space loss should be prevented as much as possible. Accordingly, it is very important for a production of a silver halide photographic light-sensitive material having a magnetic recording layer to develop a magnetic recording layer that is excellent in durability (i.e. a magnetic recording layer that does not cause emulsion peeling), because the magnetic recording layer directly contacts various kinds of machine parts. For the light-sensitive material having a magnetic recording layer, emulsion peeling has been known to occur, for example, at the interface of the magnetic recording layer and a layer containing an electrically conductive substance.

The silver halide photographic light-sensitive material having a transparent magnetic recording layer is subjected to ordinary processing steps that differ from those related to ordinary magnetic tapes (e.g. audiotapes, and videotapes). Consequently, the new problem arises that staining materials, composed of ingredients in a developing solution, adhere to the back surface of a light-sensitive material, in which a magnetic recording layer is coated on the side of the back surface, and then the said staining materials are transferred to the surface of a magnetic head at the time of the magnetic recording or reproduction after processing, which results in an error of magnetic input/output (an error in magnetic recording/reproducing). In order to solve such a problem, it is also effective to incorporate, into a backing layer, abrasives that are well known in the field of magnetic tape, for a silver halide photographic light-sensitive material having a transparent magnetic recording layer. However, when the amount of the abrasives to be added is too much, or the grain size of the abrasives is too large, the new problem arises that an abrasion speed of the magnetic head is accelerated, or the transparency of the photographic film is deteriorated, even though "stain" that is formed after processing is easily removed. Consequently, all of these problems have not completely been solved by the above-mentioned means.

SUMMARY OF THE INVENTION

Accordingly, an object of the present invention is to provide a silver halide photographic light-sensitive material having a transparent magnetic recording layer, in which the problem of emulsion peeling on the side of the back surface is hardly to arise, and in addition, an error in magnetic recording/reproducing caused after processing is also hardly to cause.

Another object of the present invention is to provide a photographic article (product) comprising the above light-sensitive material and a usual patrone system.

Other and further objects, features, and advantages of the invention will appear more fully from the following description.

DETAILED DESCRIPTION OF THE INVENTION

The above-mentioned object of the present invention is accomplished by a silver halide photographic light-sensitive material that comprises at least one silver halide emulsion layer on a support, and at least one backing layer on the other side of the support, one of which backing layers is a transparent magnetic recording layer, wherein at least one of the backing layers contains a crosslinking agent represented by general formula (1), as shown below, in the range of from 3 mg/m$^2$ to 1000 mg/m$^2$, and wherein the transparent magnetic recording layer contains an abrasive whose Moh's hardness value is not less than 5.

General formula (1)

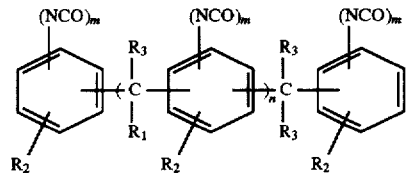

wherein n is a positive integer, including 0 (zero); m is an integer of 1 or 2; and $R_1$, $R_2$, and $R_3$ each represent a hydrogen atom, an alkyl group, or an aryl group.

PREFERRED EMBODIMENT OF THE INVENTION

A crosslinking (bridge-forming) agent represented by general formula (1) for use in the present invention is explained below.

With respect to the crosslinking agent for use in the present invention, n in general formula (1) is preferably from 0 to 50, more preferably from 0 to 30, and further preferably from 0 to 10. The number of n is not necessarily single, but may have a distribution. m is an integer of 1 or 2. $R_1$, $R_2$, and $R_3$ each represent a hydrogen atom, an alkyl group having 1 to 12 carbon atoms, and preferably 1 to 4 carbon atoms, or an aryl group having 6 to 12 carbon atoms. The viscosity of the crosslinking agent is preferably from 50 (cP/25° C.) to 1000 (cP/25° C.). Further, the NCO content of the crosslinking agent is preferably from 20 to 40%, and more preferably from 25 to 35%. Most preferably, the crosslinking agent is a polynuclear material of methylenediphenylene diisocyanate (MDI), i.e. polymeric MDI. Examples of commercially marketed products of the crosslinking agent include Millionate MT, Millionate MR- 100, Millionate MR-200, Millionate MR-300, Millionate MR-400 (each a trade name, manufactured by Japan Polyurethane Co., Ltd.), and Sumidur 44V10 (trade name, manufactured by Sumitomo Bayer Urethane Co., Ltd.).

The coating amount of the crosslinking agent for use in the present invention is generally from 3 mg/m$^2$ to 1000 mg/m$^2$, preferably from 5 mg/m$^2$ to 500 mg/m$^2$, and more preferably from 10 mg/m$^2$ to 300 mg/m$^2$.

When a crosslinking agent for use in the present invention is added to a binder that constitutes a magnetic recording layer, preferably the crosslinking agent is used in the range of from 0.3 wt % to 100 wt % based on the binder.

By the action of the crosslinking agent for use in the present invention, molecules having an active hydrogen in a binder in the backing layer of a light-sensitive material, are crosslinked. For example, molecules of diacetyl cellulose, DAC, (in a binder) cause crosslinking at their —OH groups by the isocyanate groups in the crosslinking agent.

Further, specific examples of the crosslinking agent for use in the present invention are illustrated below.

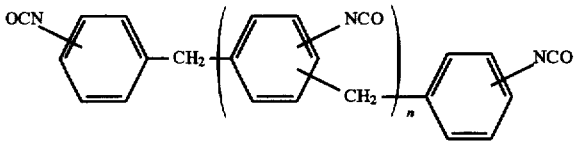

n = 0, or an integer of 1 to 5

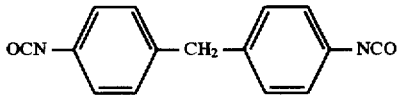

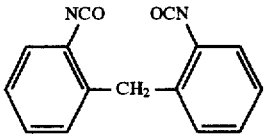

-continued

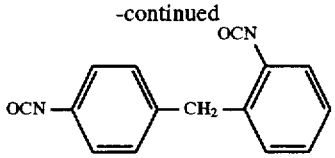

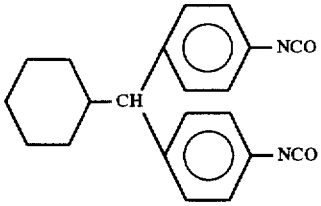

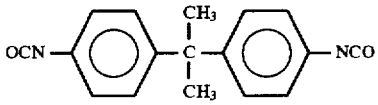

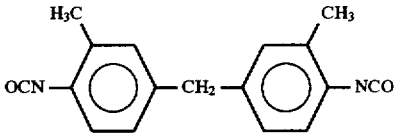

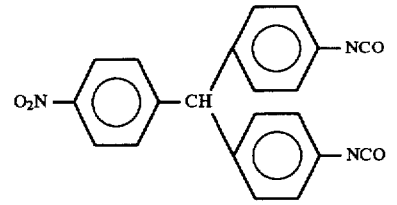

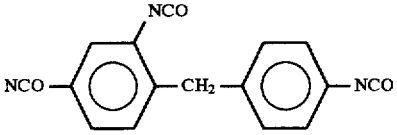

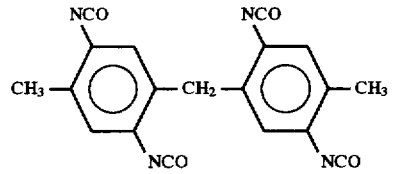

Millionate MR-100 (trade name, manufactured by Japan Polyurethane Co., Ltd.)
Millionate MR-200 (trade name, manufactured by Japan Polyurethane Co., Ltd.)
Millionate MR-300 (trade name, manufactured by Japan Polyurethane Co., Ltd.)
Millionate MR-400 (trade name, manufactured by Japan Polyurethane Co., Ltd.)

Sumidur 44V10 (trade name, manufactured by Sumitomo Bayer Urethane Co., Ltd.)

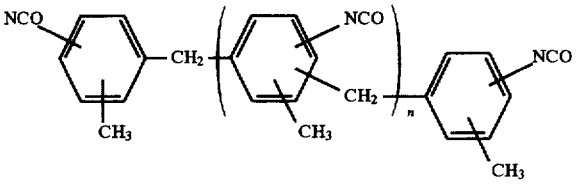

n = 0, or an integer of 1 to 5

In order to complete bridge formation using the crosslinking agent for use in the present invention, it is preferable to heat and dry at 50° C. or more, preferably 70° C. or more, for 1 min to 72 hrs. Drying for longer than 72 hrs, however, leads to minimal further bridge formation, and therefore the heating and drying over 72 hrs is deemed to have no industrial merit (advantage).

A crosslinking agent for use in the present invention is preferably incorporated in a magnetic recording layer and/or a layer adjacent to the magnetic recording layer that is coated on a backing layer, in order to prevent emulsion peeling of the magnetic recording layer that is especially important among the backing layers. The crosslinking agent is most preferably added to a magnetic recording layer.

The use of a crosslinking agent for use in the present invention, in combination with at least one of a tertiary amine, a metal salt, and DBU (1,8-diazabicyclo[5,4,0] undecene-7) at the same time, is able to accelerate the crosslinking reaction speed of the backing layer per se, or between a backing layer and a support, or between backing layers, whereby the crosslinking reaction time for improvement of durability can be shortened. The amount to be added of the above tertiary amine, metal salt, or DBU is generally a catalytic amount, for example, an amount in the order of several percents of the crosslinking agent to be used. Examples of tertiary amines are tetramethylbutanediamine, 1,4-diazabicyclo[2,2,2]octane, and triethylamine, as described in Bruins et al., *Polyurethane Technology*, p.25, Interscience (1960). Further, examples of metal salts include dibutyltin dilaurate, tin caprylate, cobalt naphthenate, stannous chloride, tetra-n-butyl tin, stannic chloride, trimethyl tin hydroxide, and dimethyl tin dichloride. These compounds may be added to a coating solution for a magnetic recording layer or a layer adjacent to the magnetic recording layer, in combination with a crosslinking agent for use in the present invention, followed by coating the thus-obtained coating solution onto a support. Additionally, or alternatively, these compounds may be added to a coating solution for an under layer and/or an upper layer to be coated below or above the above-described layer, so that these compounds can be diffused to a layer for improvement of durability. In the former embodiment in which these compounds and a crosslinking agent for use in the present invention are added to a coating solution for a layer that is expected to improve durability, it is important to select a suitable addition amount, from the viewpoint of coating aptitude, because the viscosity of the coating solution increases as the reaction progress with the lapse of time. On the other hand, in the latter embodiment, the latitude of the addition amount is wider than that of the former embodiment.

The transparent magnetic recording layer for use in the present invention means a magnetic recording layer having such transparency that photographic image quality is not substantially affected. The transparency is generally in the range of from 0 to 0.5, preferably from 0 to 0.3, and more preferably from 0 to 0.15, in terms of transmission density through a blue filter.

Examples of magnetic grains that can be contained in a transparent magnetic recording layer for use in the present invention include ferromagnetic iron oxide, such as $\gamma$-$Fe_2O_3$ ($FeO_x$, $4/3<x\leqq 3/2$), Co-coated ferromagnetic iron oxide, such as Co-coated $\gamma$-$Fe_2O_3$ ($FeO_x$, $4/3<x\leqq 3/2$), Co-coated magnetite, and further Co-doped ferromagnetic iron oxide, Co-doped magnetite, ferromagnetic chromium dioxide, ferromagnetic metal, ferromagnetic alloy, and other magnetites and ferrites, e.g. hexagonal system Ba ferrite, Sr ferrite, Pb ferrite, and Ca ferrite, and a solid solution of these substances or ion substitutes of these substances.

A method of manufacturing a ferromagnetic powder of these substances has been known, and ferromagnetic substances for use in the present invention can also be manufactured according to a publicly known method.

With respect to the form of the ferromagnetic substance, any of an acicular, a rice grain-like, a spherical, a cubic, or a tabular form may be used, with the acicular form preferred with regard to the electromagnetic conversion characteristic. The grain size and specific surface area are each not limited in particular. However, the specific surface area is preferably $S_{BET}$ of 20 $m^2/g$ or more, particularly preferably 30 $m^2/g$ or more. With respect to the grain size of the ferromagnetic substance having an acicular form, preferably the major axis is from 0.01 to 0.8 μm, and the minor axis is from 0.005 to 0.4 μm, with the ratio of the major axis to the minor axis being from (100:1) to (2:1). More preferably, the major axis is from 0.04 to 0.4 μm, and the minor axis is from 0.01 to 0.1 μm, with the ratio of the major axis to the minor axis being from (100:1) to (3:1).

Preferably, the grain size distribution of the ferromagnetic substance is as sharp as possible.

Further, grains of the ferromagnetic substance in a coating layer may be primary grains, or they may bond with each other in chains.

Saturated magnetization ($\sigma_s$) of the ferromagnetic substance is preferably as large as possible, i.e. preferably 50 emu/g or more, more preferably 70 emu/g or more. Further, the rectangular model (shape) ratio ($\sigma_r/\sigma_s$) of the ferromagnetic substance is preferably not less than 40%, and more preferably not less than 45%. When the coercive force (Hc) is too small, magnetism is easily eliminated. On the other hand, when the coercive force is too large, magnetic information cannot be written due to the capacity of a system. Accordingly, the coercive force is preferably of a moderate value, i.e. preferably in the range of from 200 Oe to 3000 Oe, more preferably from 500 Oe to 2000 Oe.

The surface of the ferromagnetic substance grains may be treated with silica and/or alumina, as described in, for example, JP-A Nos. 23505/1984 and 96052/1992. Further, magnetic substance grains whose surfaces are treated with an inorganic material and/or an organic material, as described in JP-A Nos. 195726/1992, 192116/1992, 259911/1992, and 81652/1993, can also be used. Further, the surface of the ferromagnetic substance grains may be treated with a silane coupling agent or a titanium coupling agent. Known materials, as described in, for example, JP-B ("JP-B" means examined Japanese patent publication) No. 261469/1989 and Japanese patent application No. 317118/1992, can be used as a coupling agent. Examples of coupling agents include 3-mercaptopropyl-trimethoxysilane, 3-isocyanylpropylmethyldimethoxysilane, 3-(polyoxyethynyl)oxypropyltrimethoxysilane (polymerization degree 10), 3 -methoxy(polyoxyethynyl) oxypropyl-trimethoxysilane (polymerization degree 6), and decyltrimethoxysilane.

The amount of these silane coupling agents and titanium coupling agents to be added is preferably from 1.0 to 200 wt %, based on magnetic grains, respectively. When the amount is under the above-described range, solution stability becomes poor. On the other hand, when the amount is over the range, solution stability also becomes poor. Consequently, the amount is more preferably from 1 to 75 wt %, and further preferably from 2 to 50 wt %.

Further, these silane coupling agents and/or titanium coupling agents are added to magnetic grains according to a generally known method, whereby the surface of magnetic grains is modified, and as a result the stability of a coating solution containing magnetic materials can be improved. That is, magnetic grains are treated by a direct treatment method or an integral blend method, as described in JP-A No. 161032/1994. Examples of the direct treatment method are a dry process, a slurry process, and a spray process. With respect to a dry process, preferably, magnetic grains are mixed with a small amount of water—or an organic solvent, or an organic solvent containing water—and a coupling agent, and the resulting mixture is stirred by means of an open kneader, followed by removing water and the organic solvent, and then the mixture is further finely dispersed.

In order to disperse the above-mentioned magnetic substance in a binder, described later, various known means are available, in addition to those described in Japanese patent application No. 189652/1992. One or more dispersing tools, such as a kneader, a pin-type mill, and an annular-type mill, are preferably used, with a combination of the kneader and the pin-type mill, or a combination of the kneader and the annular-type mill, also preferred. Examples of the kneader are the open type, the enclosed type, and the successive type. In addition, kneading machines, such as a three rolls mill and a laboplasto mill, can be also used. Further, dispersants, as described in JP-A No. 88283/1993, and other known dispersants, can be used for the above purpose.

The thickness of the magnetic recording layer is generally from 0.1 μm to 10 μm, preferably from 0.2 μm to 5 μm, and more preferably from 0.3 μm to 3 μm.

The ratio by weight of the magnetic substance grains to the binder is preferably from (0.5:100) to (60:100), more preferably from (1:100) to (30:100).

The coating amount of the magnetic substance is generally from 0.005 to 3 $g/m^2$, preferably from 0.01 to 2 $g/m^2$, and more preferably from 0.02 to 0.5 $g/m^2$.

The coercive force of a film having provided thereon a magnetic recording layer is generally from 500 Oe to 3000 Oe, preferably from 800 Oe to 1500 Oe.

A magnetic recording layer for use in the present invention is provided with a stripe pattern, or the layer is provided all over the surface, on the back surface of the photographic support. Further, a support having thereon a magnetic recording layer can be prepared by double coating both a solution of a binder having dispersed therein magnetic grains and a solution of a binder for a support with a stripe pattern, or by double coating these solutions all over the surface. In this case, the composition of two kinds of polymers may be different from each other, but the same composition is preferred.

The magnetic recording layer, having been coated on a support, is subjected to a processing for orientation, during the drying of magnetic materials in the layer instantly after the coating, if necessary, and then the resulting magnetic recording layer is dried. Methods of using a permanent magnet or a solenoid coil can be used for orientation of the magnetic substance. The strength of the permanent magnet is preferably not less than 2000 Oe, and particularly preferably not less than 3000 Oe. On the other hand, the strength of the solenoid coil may be 500 Oe, or more. Further, the timing of the orientation at the drying step is preferably a specific point at which an amount of the solvent remaining in a magnetic recording layer reaches the range of from 5% to 70%, as described in Japanese patent application No. 5822/1993. Further, if necessary, a magnetic recording layer can be manufactured by subjecting the layer to a process for making the surface of the layer smooth, as described in, for example, JP-B Nos. 23625/1965 and 28368/1964, and U.S. Pat. No. 3,473,960. Further, it is considered that a method described in JP-B No. 13181/1966 is a fundamental and important technology in this field.

The magnetic recording layer may be imparted with one or more functions (performances), such as lubrication improvement, curling control, antistatic nature, adhesion prevention, head abrasion, and dust-sticking prevention.

A binder for backing layers, including a magnetic recording layer, for use in the present invention is described below. The following can be used as the binder for use in the present invention: known thermoplastic resins, thermosetting resins, reactive-type resins; polymers having an acid or alkali decomposability, or a biodegradability; natural polymers (e.g. cellulose derivatives, sugar derivatives), and a mixture thereof.

The glass transition temperature, Tg, of the above resins is preferably from −40° C. to 300° C., and the weight-average molecular weight is preferably from 2,000 to 1,000,000, more preferably from 5,000 to 300,000.

Examples of the above-described thermoplastic resins include vinyl-based copolymers, such as a vinyl chloride/vinyl acetate copolymer, a vinyl chloride/vinyl acetate/vinyl alcohol/maleic acid and/or acrylic acid copolymer, a vinyl chloride/vinylidene chloride copolymer, a vinyl chloride/acrylonitrile copolymer, and an ethylene/vinyl acetate copolymer; cellulose derivatives, such as nitrocellulose, cellulose diacetate, cellulose triacetate, cellulose acetate propionate, cellulose acetate butyrate, hydroxypropyl cellulose, ethyl cellulose, methyl cellulose, carboxymethyl cellulose, hydroxyethyl cellulose, acetyldibutyl acetate, tripropionyl acetate, and didodecyl acetate; acrylic resins; polyvinyl acetal resins; polyvinyl butylol resins; polyester polyurethane resins; polyether polyurethane, polycarbonate, and polyurethane resins; polyester resins, polyether resins; polyamide resins; amino resins; rubber-based resins, such as stylene butadiene resins and butadiene acrylonitrile resins; silicone-based resins; and fluorine-based resins.

The above-described thermosetting resins and reaction-type resins are materials whose molecular weight becomes extremely high by heating. Examples of these resins include phenol resins, phenoxy resins, epoxy resins, heat-setting polyurethane resins, urea resins, melamine resins, alkyd resins, silicone resins, acryl-based reaction-type resins, epoxy-polyamide resins, nitrocellulose melamine resins, a mixture of a high molecular weight polyester resin and an isocyanate prepolymer, urea formaldehyde resins, a mixture of a low molecular weight glycol/a high molecular weight diol/polyisocyanate, polyamine resins, and a mixture of these materials.

The following polar group may be introduced into the above-listed binder: an epoxy group, $CO_2M$, OH, $NR_2$, $NR_3^{\oplus}X^{\ominus}$, $SO_3M$, $OSO_3M$, $PO_3M_2$, or $OPO_3M_2$, wherein M represents a hydrogen atom, an alkali metal, or an ammonium, with the proviso that when the group contains two or more Ms, they are the same or different; R represents a hydrogen atom or an alkyl group, and X represents a halide ion.

The above-listed binders may be used singly or in a mixture thereof, and they may contain known crosslinking agents that are outside of the present invention, such as epoxy-, aziridine-, and isocyanate-based crosslinking agents. Known isocyanate-based crosslinking agents are polyisocyanate compounds having two or more isocyanate groups, with examples including isocyanates, such as tolylene diisocyanate, hexamethylene diisocyanate, xylylene diisocyanate, naphthalene-1,5-diisocyanate, o-toluidine diisocyanate, isophorone diisocyanate, and triphenylmethane diisocyanate; reaction products of these isocyanates and polyalcohols (e.g. a reaction product of tolylene diisocyanate (3 mol) and trimethylol propane (1 mol)); and polyisocyanates produced by the condensation of these isocyanates. However, prevention of both emulsion peeling and a magnetic recording/reproduction error caused after processing cannot be achieved by adding only the above-described known crosslinking agents. It is necessary to further incorporate a crosslinking agent according to the present invention into a backing layer, to achieve this goal. In particular, when a fluorine compound, described later, is incorporated in a backing layer, the degree of improvement obtained by the use of the crosslinking agent according to the present invention is outstanding, compared with those of the known crosslinking agents that are outside of the present invention.

Of these binders constituting a magnetic recording layer, cellulose esters having a substitution degree of from 1.7 to 2.9 are particularly preferably used, because they have many advantages, such as dissolution in an organic solvent, transparency, anti-blocking with a photographic emulsion layer, and adequate thermal resistance to endure such a high temperature as that in a car in the summer season. The substitution degree herein referred to means a number of the esterified hydroxyl groups amongst three hydroxyl groups that a cellulose has per monomer unit. Therefore, a substitution degree of 2.0 indicates that one (1) hydroxyl group is remaining per monomer unit of the cellulose. The substitution degree is preferably from 1.7 to 2.9, more preferably from 2.0 to 2.8, and further preferably from 2.2 to 2.7. Examples of the cellulose esters for use in the present invention include cellulose acetate series, such as cellulose diacetate, cellulose triacetate, cellulose acetate butylate, and cellulose acetate propionate; cellulose nitrate; cellulose sulfate; and a mixture of these esters, with cellulose diacetate, cellulose acetate butylate, cellulose acetate propionate and cellulose nitrate preferred. When a crosslinking agent according to the present invention is used, the above-listed cellulose ester binders are especially preferably used as a binder for the magnetic recording layer, from the viewpoint of thermal resistance and the like.

In the present invention, a water-soluble binder preferably exists on the surface of the side having coated thereon a transparent magnetic recording layer.

The water-soluble binders preferably used in the present invention are, for example, binders disclosed on page 26 of Research Disclosure No. 17643, on page 561 of ibid. No. 18716, and in *Polymer Handbook*.

Examples of the water-soluble binder for use in the present invention are cellulose derivatives, such as carboxymethyl cellulose (CMC), carboxymethylethyl cellulose (CMEC), carboxymethylhydroxyethyl cellulose (CMHEC), hydroxyethyl cellulose (HEC), hydroxypropyl cellulose (HPC), hydroxypropylmethyl cellulose (HPMC), and methyl cellulose (MC).

Further, examples of synthetic polymers, as other water-soluble binders, are polyvinyl alcohol (PVA), polyethylene glycol, polyvinyl pyrrolidone, polyacrylamide, polymethacrylamide, polyallylamine, polyvinyl pyridine, derivatives of these synthetic polymers, maleic anhydride-based copolymers, and resins having introduced in them a hydrophilic substituent to provide water-solubility to the binder, such as water-soluble alkyd resins, water-soluble melamine resins, water-soluble urea resins, water-soluble phenol resins, water-soluble epoxy resins, and water-soluble polybutadiene resins.

The water-soluble binders preferably used are cellulose derivatives, such as CMC, CMEC, CMHEC, HEC, HPC, HPMC, and MC, and among them, HEC, HPC, and HPMC are most preferable.

The molecular weight of the water-soluble binders is preferably not less than 10,000.

The water-soluble binder for use in the present invention shows effects to improve signal input/output problems, when the water-soluble binder is contained in at least one layer, which is over a transparent magnetic recording layer, and which exists on the surface of the side having coated thereon the transparent magnetic recording layer. The water-soluble binder for use in the present invention is preferably contained in the outermost layer or the layer adjacent to the outermost layer.

The added amount of the water-soluble binder for use in the present invention is preferably from 0.05 to 200 mg/m$^2$, more preferably 0.1 to 50 mg/m$^2$, further preferably 0.1 to 25 mg/m$^2$, and particularly preferably 0.1 to 5 mg/m$^2$.

The water-soluble binder for use in the present invention may be used as a mixture of two or more of the binders, and it may also be used in combination with a water-insoluble binder. The thickness of the layer containing the water-soluble binder is preferably 0.5 μm or less, more preferably 0.1 μm or less, further preferably 0.05 μm or less, and particularly preferably 0.02 μm or less.

A support for use in the present invention is described below.

A film support that can be used in the present invention is not limited in particular, but various kinds of plastic films can be used. Preferred materials of the plastic films are cellulose derivatives (e.g. diacetyl-, triacetyl-, propionyl-, butanoyl-, acetylpropionylacetates), polyamides, polyesters, and polycarbonates. More preferred materials are polyesters. Of these polyester supports, preferred are those having a glass transition temperature (Tg) in the range of from 50° C. to 200° C., more preferably from 90° C. to 200° C. The Tg herein referred to is defined by means of a scanning-type differential thermal analyzer (DSC), as follows: First, 10 mg of a sample is heated in a nitrogen current up to 300° C., at the rate of temperature rise of 20° C./min, and then it is rapidly cooled to room temperature. After that, the sample is heated again, at the rate of temperature rise of 20° C./min. The arithmetic mean value of the temperature at which deviation from the baseline begins, and the temperature at the time of return to the new baseline, is defined as the Tg.

A polyester support for use in the present invention.

The polyester for use in the present invention is obtained by a polymerization condensation reaction of a diol (especially ethylene diglycol) with an aromatic dicarboxylic acid (e.g. terephthalic acid, isophthalic acid, phthalic acid, phthalic anhydride, naphthalene dicarbonic acid (2,6-, 1,5-, 1,4-, 2,7-)).

A polyester containing 2,6-naphthalene dicarboxylic acid as an acidic reaction component, at a content of 50 mol % or more, preferably 70 mol % or more, of the total dicarboxylic acid, is preferred. Polyethylene 2,6-naphthalene dicarboxylate is especially preferred.

These copolymers and homopolymers can be synthesized by previously known methods of producing polyesters. For example, polyesters can be synthesized by subjecting an acidic component and a glycol component directly to esterification, or, when a dialkylester is used as an acidic component, by subjecting the dialkylester and a glycol component to transesterification, and then removing an excess glycol component while heating under reduced pressure. Polyesters can also be prepared by reacting an acid halide, as an acidic component, with glycol. During these reactions, optional use can be made of transesterification catalysis or polymerization reaction catalysis, or a heat-resistant stabilizer may be added. These preparations of polyesters can be performed with reference to, for example, "Condensation polymerization and Addition polymerization," High Molecular Experimental Study No. 5, pp 103–136, published by Kyoritsu Shuppan (1980), and "Synthetic High Molecule V," pp 187–286, published by Asakura Shoten (1971).

The preferable average molecular weight of these polyesters is within the range of about 5,000 to 200,000, and intrinsic viscosity measured at 35° C. in a o-chlorophenol is preferably 0.4 or more, but 1.0 or less, and more preferably 0.45 or more, but 0.75 or less.

Preferable specific examples of polyesters that can be used in the present invention are mentioned below, which, however, are not intended to restrict the scope of the present invention.

Examples of Polyester Compounds

| | | |
|---|---|---|
| P-0: | [Terephthalic acid (TPA)/Ethylene glycol (EG) (100/100)] (PET) | Tg = 80° C. |
| P-1: | [2,6-Naphthalene dicarboxylic acid (NDCA)/ Ethylene glycol (EG) (100/100)] (PEN) | Tg = 119° C. |
| P-2: | [Terephthalic acid (TPA) /Cyclohexane-dimethanol (CHDM) (100/100)] | Tg = 93° C. |
| P-3: | [TPA/bisphenol A (BPA) (100/100)] | Tg = 192° C. |
| P-4: | 2,6-NDCA/TPA/EG (50/50/100) | Tg = 92° C. |
| P-5: | 2,6-NDCA/TPA/EG (75/25/100) | Tg = 102° C. |
| P-6: | 2,6-NDCA/TPA/EG/BPA (50/50/75/25) | Tg = 112° C. |
| P-7: | TPA/EG/BPA (100/50/50) | Tg = 105° C. |
| P-8: | TPA/EG/BPA (100/25/75) | Tg = 135° C. |
| P-9: | TPA/EG/CHDM/BPA (100/25/25/50) | Tg = 115° C. |

The thickness of these supports used in the present invention is generally within the range of 50 μm or more, but 300 μm or less, preferably 50 to 200 μm, more preferably 80 to 115 μm, and particularly preferably 85 to 105 μm.

The polyester support used in the present invention is preferably heat treated.

A heat treatment is carried out at a temperature preferably within the range of (Tg–50° C.) or more, but less than Tg (e.g. when Tg is 90° C. or more, 40° C. or more, but less than Tg), more preferably (Tg –20° C.) or more, but less than Tg. The period of time for the heat treatment is preferably from 0.1 to 1,500 hours. At a temperature lower than 40° C., it takes longer time to obtain sufficient effect on prevention of the core set curl and industrial productivity is worse.

It is preferable to heat-treat at the constant temperature within the above range or while cooling. An average cooling speed is preferably from –0.01° to –20° C./hour, more preferably from –0.1° to –5° C./hour.

In order to further improve the effect on prevention of the core set curl, it is preferred to heat-treat at a temperature of Tg or higher, but lower than the melting point (measured by DSC), prior to the above-described heat treatment, so as to remove thermal hysteresis of the support. Then a reheat treatment is performed at the above-described temperature of 40° C. or more, but less than Tg.

In the present invention, this heat treatment is referred to as "preheat treatment," and the above-described heat treatment at the temperature of 40° C. or more, but less than Tg is referred to as "post-heat treatment." Thus, these treatments are distinguished from each other. Therefore the heat treatment of the present invention can be divided to these preheat treatment and post-heat treatment.

The temperature for the preheat treatment is preferably Tg or higher, but lower than the melting point of polyester, and more preferably Tg +20° C. or higher, but not higher than the crystallization temperature (measured by DSC).

The period of time for the preheat treatment is preferably from 0.1 minute to 1,500 hours.

It is preferred that such a heat treatment of a support can be carried out while conveying a roll-like or web-like support.

The above-mentioned heat treatments may be carried out at any stage subsequent to the production of a support (film), the surface treatment (an ultraviolet ray, glow discharge, corona, or flame treatment), the coating of a backing layer containing an antistatic agent, a lubricant, and the like; or the coating of a subbing layer. A step subsequent to the coating of the antistatic agent is preferred. Such a coating of the antistatic agent is able to prevent adhesion of dust due to electrification, which dust causes a defect on a surface of the support during heat treatment.

In order to give these supports flexibility and the like, plasticizers may be added thereto. In particular, a composition containing a plasticizer, such as triphenyl phosphate, biphenyldiphenyl phosphate, and dimethylethyl phosphate, is usually used in a cellulose ester.

The support may contain a dye for various purposes of neutralization of base coloring, light-piping prevention, and antihalation.

These supports may be subjected to a surface treatment, in order to achieve strong adhesion between the support and a photographic constituting layer (e.g. a light-sensitive silver halide emulsion layer, an interlayer, a filter layer, a magnetic recording layer, an electrically conductive layer), and then a photographic emulsion is coated directly onto the support. For the above-mentioned surface treatment, various surface-activation treatments can be used, such as a chemical treatment, a mechanical treatment, a corona discharge treatment, a flame treatment, an ultraviolet ray treatment, a high-frequency treatment, a glow discharge treatment, an active plasma treatment, a laser treatment, a mixed acid treatment, and an ozone oxidation treatment. Alternatively, once the support is subjected to the above-described surface treatment, or if the surface treatment is omitted, then a subbing layer may be coated on the support, followed by a coating of a photographic emulsion layer on the subbing layer. These surface treatments can be conducted according to the known methods.

Further, a subbing layer is explained below.

For cellulose derivatives, a solution of gelatin dispersed in a mixed organic solvent, consisting of methylene chloride, ketone, and alcohol, is coated, so that a single subbing layer can be provided.

For the polyester-type supports, the following coating methods are available: a so-called multilayer method, in which a layer that is able to adhesive well to a support is coated thereon as the first layer (hereinafter referred to as the first subbing layer), and a hydrophillic resin layer that is able to adhesive well to both the photographic constituting layer and the first subbing layer as the second layer (hereinafter referred to as the second subbing layer) is further coated on the first subbing layer; and a single layer method, in which a single layer of a resin having both a hydrophobic group and a hydrophilic group is coated.

In the first subbing layer according to the multilayer method, the following polymers can be used: copolymers produced by using monomers selected from vinyl chloride, vinylidene chloride, butadiene, methacrylic acid, acrylic acid, itaconic acid, maleic anhydride, and the like as a starting material; and other polymers, such as polyethylene imine, epoxy resins, graft gelatin, and nitrocellulose. Further, the use of gelatin has been considered as a main polymer for the second subbing layer.

On the other hand, in the single layer method, a method in which good adhesion can be achieved by swelling a support, followed by an interfacial mixing of the swollen support with a hydrophilic subbing polymer, is often used. Examples of the hydrophilic subbing polymers include a water-soluble polymer, such as gelatin, gelatin derivatives, casein, agar—agar, sodium alginate, starch, polyvinyl alcohol, a polyacrlylic acid-based copolymer, and a maleic anhydride-based copolymer; a cellulose ester, such as carboxymethyl cellulose and hydroxyethyl cellulose; and a latex polymer, such as a vinyl chloride-containing copolymer, a vinylidene chloride-containing copolymer, an acrylic acid ester-containing copolymer, and a vinyl acetate-containing copolymer, with gelatin preferred.

Further, examples of the compounds that can be used to swell a support for use in the present invention include resorcin, chlororesorcin, o-cresol, m-cresol, p-cresol, phenol, o-chlorophenol, p-chlorophenol, dichlorophenol, trichlorophenol, monochloroacetic acid, dichloroacetic acid, trifluoroacetic acid, and chloral hydrate. Preferred of these materials are resorcin and p-chlorophenol.

For the above-mentioned hydrophilic subbing polymers, the above-mentioned hardeners for a hydrophilic polymer are also used.

A subbing solution, if necessary, may contain various kinds of additives, such as a surfactant, an antistatic agent, an antihalation agent, a coloring dye, a pigment, a coating aid, and an antifoggant.

Further, the subbing layer for use in the present invention may contain inorganic fine particles, such as $SiO_2$ and $TiO_2$, or polymethyl methacrylate copolymer fine particles (1 to 10 μm), as a matting agent.

A sub-coating solution that is used in the present invention can be coated on a support by any one of generally well-known methods, such as a dip coating, an air-knife coating, a curtain coating, a roller coating, a wirebar coating, a gravure coating, and an extrusion coating using a hopper, as described in the specification of U.S. Pat. No. 2,681,294. Furthermore, according to circumstances, multilayers can be simultaneously coated by a method as described, for example, in the specifications of U.S. Pat. Nos. 2,761,791, 3,508,947, 2,941,898, and 3,526,528, and in Yuji Harasaki, *Coating Technology* (Coating Kogaku) p. 253 (edited by Asakura Shoten, 1973).

Further, particularly preferably the following fine grains can be used as an antistatic agent that does not lose its electrical conductivity even by a processing: crystalline metal oxide fine grains, in which the metal oxide is at least one selected from the group consisting of ZnO, $TiO_3$, $SnO_2$, $Al_2O_3$, $In_2O_3$, $SiO_2$, MgO, BaO, $MoO_3$, and $V_2O_5$; and fine grains of composite oxides of them. An especially preferable antistatic agent is an electrically conductive material containing $SnO_2$ as a main component, and also containing antimony oxide in an amount of from about 5% to 20%, and/or other components (e.g. silicon oxide, B, P). These electrically conductive crystalline metal oxides, or their composite oxide fine grains, preferably have a volume resistivity of $10^7$ Ω·cm or less, more preferably $10^5$ Ω·cm or less. Further, their grain size of primary grains, in terms of major axis, is preferably from 0.005 to 0.7 μm, particularly preferably from 0.005 to 0.3 μm. Further, as another antistatic agent, known ionic polymers having the resistivity similar to the above metal oxides, can be used.

These antistatic agents may be incorporated in at least one of photographic constituting layers, such as a subbing layer on the back side, any one of backing layers, including the most outer backing layer, a subbing layer on the same side on which a photographic emulsion is coated, any one of photographic emulsion layers, an interlayer, and the most outer layer on the same side on which the photographic emulsion layer is coated. In particular, the antistatic agent is preferably incorporated in a more inner layer than the magnetic recording layer on the back side, in order to restrain electrostatic noise as much as possible, at the time of magnetic reproduction. A binder that is used at that time is not limited in particular, and therefore, the binder may be water soluble or organic-solvent soluble, or alternatively it may be a crosslinked binder, like a latex polymer.

The light-sensitive material of the present invention preferably has, as backing layers, the layer containing an electrically conductive substance (the antistatic agent), the magnetic recording layer, and an over coat layer (a protective layer, e.g. the above water-soluble binder-containing layer), applied in this order on a base.

Further, preferably these electrically conductive metal oxides exist in a layer in a fashion that primary grains of metal oxides are partially aggregated. It is preferable, from several points of view, to design a light-sensitive material having an antistatic layer containing the above antistatic agent, so that the volume resistivity of the light-sensitive material will be $10^{12}$ Ω·cm or less, preferably $10^{10}$ Ω·cm or less (25° C./10% RH).

Further, preferably a matting agent is incorporated in a backing layer for use in the present invention, from several points of view, such as prevention of creaking caused at the time of handling of the base, occurrence of scratches, blocking between the surface of a subbing layer on the base and the back surface, and blocking between the surface on the same side on which a photographic emulsion layer is coated and the back surface. Further, the use of the matting agent is preferable because stain (e.g. ingredients of a processing solution, dust, and dirt from hands) that has adhered to the back surface of a film can be prevented from transferring to the surface of a magnetic head. The matting agents for use in the present invention are not limited in particular, but preferably they are inorganic compounds and high molecular compounds whose glass transition temperature (Tg) is 50° C. or higher. These matting agents may be used in a mixture thereof.

Examples of the above-described inorganic compounds include a fine powder of inorganic compounds, such as barium sulfate, manganese colloids, titanium dioxide, strontium barium sulfate, and silicon dioxide; and further such as silicon dioxide, such as a synthetic silica that can be obtained by a method, e.g. a wet method and gelation of silicic acid; and also further such as titanium dioxide (rutile type and anatase type) that can be obtained by a reaction of titanium slag with sulfuric acid. Further, the matting agents can also be obtained by grinding an inorganic compound having a relatively large grain size (e.g. 20 μm, or more) into a powder, and then classifying them by means of, for example, vibrating strainer or wind force classification.

Further, examples of the high molecular compounds include polytetrafluoroethylene, cellulose acetate, polystyrene, polymethyl methacrylate, polypropyl methacrylate, polymethyl acrylate, polyethylene carbonate, starch, and their pulverized and classified materials. Further, grains of the following high molecular compounds, produced by such various methods as suspension polymerization, spray-drying, and dispersion, can also be used as a matting agent: high molecular compounds that are homopolymers and copolymers produced by one or more of monomers, such as acrylic acid esters, methacrylic acid esters, itaconic acid diesters, crotonic acid esters, maleic acid diesters, phthalic acid diesters, styrene derivatives, vinyl esters, acrylamides, vinyl ethers, allyl compounds, vinyl ketones, vinyl heterocyclic compounds, acrylonitriles, methacrylonitriles, and multifunctional monomers.

These matting agents may exist as primary grains or secondary aggregate grains, in a coating layer. At this time, the average grain size is preferably from 0.1 to 1.5 μm, more preferably from 0.3 to 1.0 μm. Further, the content of these matting agents is generally from 1 to 1000 mg/m$^2$, preferably from 3 to 300 mg/m$^2$, and more preferably from 5 to 100 mg/m$^2$.

Further, preferably abrasives are incorporated in a backing layer for use in the present invention, from the viewpoint that even though stain is adhered to the surface of a magnetic head, it can be removed by abrasives. Further, the use of abrasives preferably provides such several advantages as that a scratched or oxidized surface of the magnetic head can be polished, and consequently contact of the magnetic head with a film can be rendered smoother, and the further advantage that the capacity of the magnetic head can be recovered.

Preferably abrasives for use in the present invention are nonspherical inorganic grains having Mohs' hardness values of not less than 5, from the viewpoint that stain that has adhered to a magnetic head can be effectively cleaned.

Preferable examples of the composition of the nonspherical inorganic grains are oxides, such as aluminium oxides (e.g. α-alumina, γ-alumina, corundum), chromium oxides (e.g. $Cr_2O_3$), iron oxides (e.g. α-$Fe_2O_3$), silicon dioxide, and titanium dioxide; carbides, such as silicon carbide (SiC) and titanium carbide; and a fine powder of such as diamond, with aluminium oxides and chromium oxides more preferred. These abrasives may exist as primary grains or secondary aggregate grains, in a coating layer. At this time, an average grain size is preferably from 0.1 to 1.5 μm, more preferably from 0.3 to 1.0 μm. Further, the content of the abrasives is generally from 1 to 1000 mg/m$^2$, preferably from 3 to 300 mg/m$^2$, and more preferably from 5 to 100 mg/m$^2$.

Further, preferably fluoro compounds (fluorine-containing compounds) are incorporated in a backing layer for use in the present invention, from the viewpoint that adhesion of a stain to the back surface is prevented, which restrains the transfer of stain to the surface of a magnetic head and therefore reduces magnetic input/output problems. The fluorine-containing compound for use in the present invention is a compound containing at least three fluorine atoms; it may be a surfactant or a polymer. These compounds may contain a nonionic, anionic, cationic, or betain-type functional group as a hydrophilic group. Preferred of these functional groups are anionic, cationic, and betain-type groups, with anionic groups particularly preferred.

The fluorine-containing compound that can be particularly preferably used is a fluorine-containing surfactant, and typical specific examples of the fluorine-containing compounds are illustrated below.

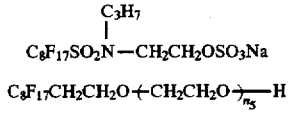

$n_5$:12

-continued

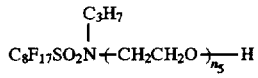

$N_5$:11

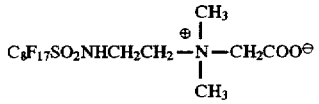

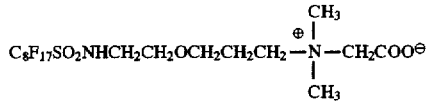

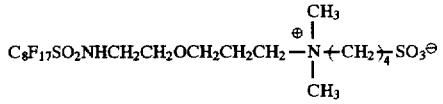

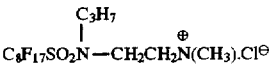

$C_7F_{15}COOH$ $C_8F_{17}SO_3K$

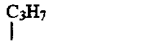

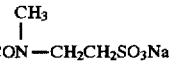

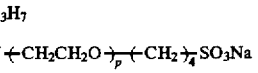

p:Average 4

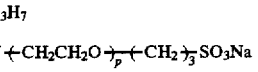

p:Average 7

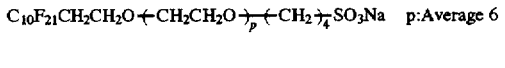

p:Average 6

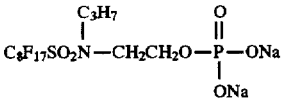

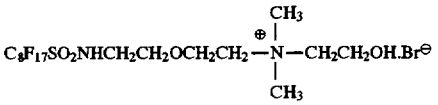

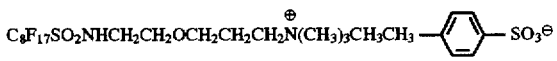

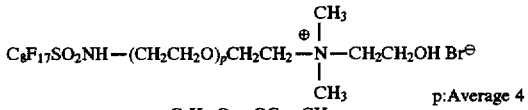

p:Average 4

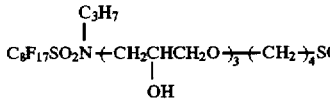

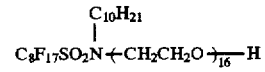

The amount to be used of the fluoro compound for use in the present invention is preferably from 0.1 mg to 1 g, more preferably from 0.5 to 100 mg, further preferably from 1 to 30 mg, and most preferably from 1.5 to 15 mg, per $m^2$ of the photographic light-sensitive material, respectively.

The addition layer of the fluoro compound for use in the present invention is not limited in particular, but it may be any one or more of layers, such as a subbing layer, an antistatic layer, a magnetic recording layer, and a slipping (lubricant) layer. Preferred of these layers is the most outer layer on the same side on which a photographic emulsion layer is coated, and/or on the back side.

Further, the backing layer for use in the present invention may contain other additives, such as a dye and a surfactant.

The conditions of the fluorine compound existing near the surface can be shown by an $F_{1s}$ peak strength/$C_{1s}$ peak strength ratio.

In the present invention, the $F_{1s}$ peak strength/$C_{1s}$ peak strength ratio is generally in the range of 0.05 to 2.0, preferably 0.06 to 1.5, more preferably 0.07 to 1.3, and further preferably 0.08 to 1.0.

A slipping agent for use in the present invention is described below in detail.

The slipping agent is incorporated in a surface layer of the light-sensitive material. The surface layer may be a surface layer on the same side on which a photographic emulsion layer is coated. However, it is much more effective to incorporate the slipping agent in a back surface layer rather than the above-mentioned surface layer, because the back surface more often directly contacts various machine parts, at the time of handling of the photographic light-sensitive material.

The following known compounds can be used as a slipping agent for use in the present invention: polyorganosiloxanes, higher fatty acid amides, higher fatty acid esters (esters of fatty acids having 10 to 24 carbon atoms and alcohols having 10 to 24 carbon atoms), metal salts of higher fatty acids, esters of straight-chain higher fatty acids and straight-chain higher alcohols, esters of higher fatty acids having a branched alkyl group and higher alcohols, and the like.

Examples of the polyorganosiloxanes to be used include generally known compounds, such as polyalkylsiloxanes (e.g. polydimethylsiloxane and polydiethylsiloxane), and polyarylsiloxanes (e.g. polydiphenylsiloxane and polymethylphenylsiloxane); and in addition, modified polysiloxanes, such as organopolysiloxanes containing an alkyl group having not less than 5 carbon atoms, alkylpolysiloxanes having a polyoxyalkylene group at the side chain, and organopolysiloxanes having an alkoxy group, a hydroxy group, a hydrogen atom, a carboxyl group, an amino group, and/or a mercapto group at the side chain, as disclosed in, for example, JP-B Nos. 292/1978, 49294/1980, and JP-A No. 140341/1985; block copolymers having a siloxane unit; and graft copolymers having a siloxane unit at the side chain, as disclosed in JP-A No. 191240/1985.

Further, the following compounds can be used as the higher fatty acids and their derivatives, and as the higher alcohols and their derivatives: higher fatty acids, metal salts of higher fatty acids, higher fatty acid esters, higher fatty acid amides, esters of higher fatty acids and polyhydric alcohols, and in addition, higher aliphatic alcohols, monoalkylphosphites of higher aliphatic alcohols, dialkyl phosphites of higher aliphatic alcohols, trialkylphosphites of higher aliphatic alcohols, monoalkylphosphates of higher aliphatic alcohols, dialkylphosphates of higher aliphatic alcohols, trialkylphosphates of higher aliphatic alcohols; and, esters of higher aliphatic alcohols and alkyl sulfonic acid, their amide compounds, and their salts.

The coefficient of kinematic friction of the slipping compound is preferably 0.25 or less, more preferably 0.01 to 0.15.

Especially preferred examples of these slipping compounds are illustrated below.

(14-1)
$n\text{-}C_{15}H_{31}COOC_{30}H_{61}\text{-}n$
(14-2)
$n\text{-}C_{17}H_{35}COOC_{40}H_{81}\text{-}n$
(14-3)
$n\text{-}C_{15}H_{31}COOC_{50}H_{101}\text{-}n$
(14-4)
$n\text{-}C_{27}H_{43}COOC_{28}H_{57}\text{-}n$
(14-5)
$n\text{-}C_{21}H_{43}COOCH_2CH(CH_3)\text{—}C_9H_{19}$
(14-6)
$n\text{-}C_{21}H_{43}COOC_{24}H_{49}\text{-iso}$
(15-1)
$n\text{-}C_{29}H_{49}OCO(CH_2)_2COOC_{24}H_{49}\text{-}n$
(15-2)
$n\text{-}C_{18}H_{37}OCO(CH_2)_4COOC_{40}H_{81}\text{-}n$
(15-3)
$n\text{-}C_{18}H_{37}OCO(CH_2)_{18}COOC_{18}H_{37}\text{-}n$
(15-4)
$\text{iso-}C_{24}H_{49}OCO(CH_2)_4COOC_{24}H_{49}\text{-}n$
(15-5)
$n\text{-}C_{40}H_{81}OCO(CH_2)_2COOC_{50}H_{101}\text{-}n$
(15-6)
$n\text{-}C_{17}H_{35}COO(CH_2)_6OCOC_{17}H_{35}\text{-}n$
(15-7)
$n\text{-}C_{21}H_{43}COO(CH_2)_{18}OCOC_{21}H_{43}\text{-}n$
(15-8)
$\text{iso-}C_{23}H_{47}COO(CH_2)_2OCOC_{23}H_{47}\text{-}n$
(15-9)
$\text{iso-}C_{15}H_{31}COO(CH_2)_6OCOC_{21}H_{43}\text{-}n$ The amount of the slipping agent to be used to manifest a sufficient slipping property and scratch resistance is preferably from 0.001 to 0.1 g/$m^2$, more preferably from 0.005 to 0.05 g/$m^2$. The slipping agents having a hydroxyl group and/or an amino group are especially preferred. Specific examples of the compounds are illustrated below, but examples are not limited to those shown:

(16-1) $HOCO(CH_2)_{10}COOC_{21}H_{43}$
(16-2) $C_{17}H_{35}COOCH_2CH(OH)C_{12}H_{25}$
(16-3) $C_9H_{19}C(OH)(C_9H_{19})CH_2COOC_{25}H_{51}$
(16-4) $C_6H_{13}CH(OH)(CH_2)_{10}COOC_{40}H_{81}$
(16-5) $C_{14}H_{29}CH(NH_2)COO(CH_2)_nCH(CH_3)(CH_2)_m\text{—}CH_3$ (n + m = 15)
(16-6) $CH_3(CH_2)_2CH(COONa)(CH_2)_6COOC_{40}H_{81}$
(16-7) $HOCH_2(CH_2)_6CH(OH)CH(OH)(CH_2)_4COO\text{—}C_{50}H_{101}$
(16-8) $C_{17}H_{33}COO(CH_2)_{16}OH$
(16-9) $CH_3(CH_2)_2CH(OH)(CH_2)_6CONHC_{21}H_{42}$
(16-10) $C_7H_{15}\text{-}\phi\text{-}COOCH(CONH_2)C_{16}H_{33}$
(16-11) $C_{27}H_{55}COOCH_2CH(OH)CH_2OH$ -continued

| | |
|---|---|
| (16-12) | $HOCO(CH_2)_5COOC_{40}H_{81}$ |
| (16-13) | $CH_3(CH_2)_{15}CH(SO_3Na)COOCH_2CH(C_{13}H_{27})—C_{10}H_{21}$ |
| (17-1) | $C_{14}H_{29}CHCOO(CH_2)_5OCOCH(OH)C_{14}H_{29}$ |
| (17-2) | $C_{10}H_{21}COOCH(C_2H_5)(CH_2)_7CH(C_2H_4COOH)—OCOC_{10}H_{21}$ |
| (17-3) | $NaOCO(CH_2)_{11}COO(CH_2)_{10}OCO(CH_2)_{11}—COOH$ |
| (17-4) | $C_9H_{19}C(OH)(C_9H_{19})CH_2COO(CH_2)_{15}CONH—C_{10}H_{21}$ |
| (17-5) | $H_2NCO(CH_2)_{10}COOCH(C_6H_{13})(CH_2)_{10}COO—C_{30}H_{61}$ |
| (17-6) | $C_{14}H_{29}CH(N^+(CH_3)_4Cl^-)COO(CH_2)_{10}OCO—C_{17}H_{33}$ |
| (17-7) | $C_6H_{13}CH(OH)(CH_2)_{10}COO(CH_2)_8OCO—(CH_2)_{10}CH(OH)C_6H_{13}$ |
| (17-8) | $C_{15}H_{31}COOCH_2CH(OH)CH_2OCOC_{15}H_{31}C_8H_{17}NHCO(CH_2)_{10}COO(CH_2)_{15}OH$ |
| (17-9) | $C_{40}H_{81}OCO(CH_2)_5COO(CH_2)_5COOH$ |
| (17-10) | $CH_3(CH_2)_{15}CH(SO_3Na)COO(CH_2)_2CH(CH_3)—(CH_2)_2OCOC_{17}H_{35}$ |
| (17-11) | $HOCH_2CH(OH)CH_2OC(CH_2)_3CH(C_2H_5)—(CH_2)_9COOC_{50}H_{101}$ |

The compounds represented by the above-mentioned general formula exhibit a high hydrophobic property, and therefore many of them are poorly soluble in a solvent. Consequently, use can be made of a method in which they are dissolved in a nonpolar organic solvent, such as toluene, and xylene; or alternatively a method in which they are dispersed in a coating solution, with the latter preferred, because a nonpolar organic solvent is difficult to handle. At this time, any kinds of dispersants may be used, as long as they do not deteriorate the slipping property and the scratch resistance. But, preferred examples of the dispersants are illustrated below.

(18-1)
$n\text{-}C_{30}H_{61}O(CH_2CH_2O)_{10}H$
(18-2)
$n\text{-}C_{40}H_{81}O(CH_2CH_2O)_{15}H$
(18-3)
$n\text{-}C_{50}H_{101}O(CH_2CH_2O)_{16}H$
(18-4)
$n\text{-}C_{50}H_{101}O(CH_2CH_2O)_{30}H$
(18-5)
$n\text{-}C_{40}H_{81}O(CH_2CH_2O)_{10}H$
(18-6)
$n\text{-}C_{50}H_{101}(CH_2CH_2O)_{16}H$
(18-7)
$n\text{-}C_{50}H_{101}—(CH(CH_3)CH_2O)_3(CH_2CH_2O)_{16}H$
(18-8)
$n\text{-}C_{50}H_{101}—(CH_2CH(OH)CH_2O)_3—(CH(OH)CH_2O)_3—$
$—(CH_2CH_2O)_{15}H$
(18-9)
$n\text{-}C_{40}H_{81}OCOCH_2CH_2COO(CH_2CH_2O)_{16}H$
(18-10)
$n\text{-}C_{50}H_{101}OCOCH{=}CHCOO(CH_2CH_2O)_{16}H$
(18-11)
$n\text{-}C_{50}H_{101}OCOCH_2CH_2COO—(CH_2CH(OH)CH_2O)_3—$
$—(CH_2CH_2O)_{15}H$ Particularly preferably, a binder that is capable of forming a film is incorporated in the layer containing these compounds, from such points of view as improvement in smoothness of the slipping agent-containing coating layer, and improvement in film strength thereof. Example polymers for use are known thermalplastic resins, thermal-setting resins, radiation-setting resins, reactive resins, and a mixture thereof, latex polymers, and hydrophilic binders, such as gelatin.

Specifically, examples of the thermal plastic resin include cellulose derivatives, such as cellulose triacetate, cellulose diacetate, cellulose acetate maleate, cellulose acetate phthalate, hydroxyacetylcellulose phthalate, cellulose long-chain alkyl esters, nitrocellulose, cellulose acetate propionate, cellulose acetate butylate resin; vinyl copolymers, such as vinyl chloride/vinyl acetate copolymer, vinyl chloride or vinyl acetate/vinyl alcohol, maleic acid and/or acrylic acid copolymer, vinyl chloride/vinylidene chloride copolymer, vinyl chloride/acrylonitrile copolymer, and ethylene/vinyl acetate copolymer; acrylic acid resins, polyvinyl acetal resins, polyvinyl butyrol resins, polyester polyurethane resins, polyether polyurethane resins, polycarbonate polyurethane resins, polyester resins, polyether resins, polyamide resins, amino resins; gum resins, such as stylene/butadiene resins and butadiene/acrylonitryl resins; silicone resins, and fluoric resins.

Radiation-setting resins for use include those in which a group having a carbon—carbon unsaturated bond as a functional group for the radiation-setting is connected to the above-described thermal plastic resin. Preferable examples of such a functional group are an acryloyl group and a methacryloyl group.

To the above-described bound molecules, a polar group may be introduced (an epoxy group, $CO_2M$, OH, $NR_2$, $NR_3^{\oplus}X^{\ominus}$, $SO_3M$, $OSO_3M$, $PO_3M_2$, $OPO_3M_2$, wherein M represents a hydrogen atom, an alkali metal, or an ammonium group; and when there are two or more M's in a group, they may be different from each other; R represents a hydrogen atom or an alkyl group; and X represents a halide ion).

The above-illustrated high-molecular binders may be used singly or in a mixture thereof. They can be used for a setting treatment with a known bridging agent of isocyanate type, and/or a radiation-setting vinyl monomer.

A protective layer containing a hydrophilic binder described above may be hardened with a hardening agent. Example hardening agents that may be used are aldehyde compounds, such as formaldehyde and glutaraldehyde; ketone compounds, such as diacetyl and cyclopentanedione; bis(2-chloroethylurea), 2-hydroxy-4,6-dichloro-1,3,5-triazine, and other reactive halogen-containing compounds; divinylsulfone, 5-acetyl-1,3-diacryloylhexahydro-1,3,5-triazine, and other reactive olefin-containing compounds; N-hydroxymethylphthalimide, N-methylol compounds, isocyanate compounds, aziridine compounds, acid derivatives, epoxy compounds, and halogen carboxy aldehydes, such as mucochloric acid. Further, example inorganic hardening agents are chrome alum and zirconium sulfate. And additionally, active carboxyl group-containing hardening agents can be used.

Particularly preferred of these binders are those containing a polar substituent in their molecules. Examples of the polar substituent are —OH, –COOH, —COOM, $—NH_3$, $—NR_4^+$, $—CONH_2$, —SH, $—OSO_3M$, and $—SO_3M$. An especially preferred specific example of the binder is acetylcellulose.

Some additives may be added to a layer containing the above-mentioned slipping agent, in order to impart other functions. For example, a surfactant having a sulfonic acid group or a sulfuric acid ester group as a hydrophilic portion is preferably used as such an additive, to improve cissing (repelling) due to a hydrophobic slipping agent. Examples of the surfactant are illustrated below.

(19-1)
$C_{12}H_{25}OSO_3Na$
(19-2)
$C_{16}H_{33}OSO_3Na$
(19-3)
$C_{18}H_{37}\phi SO_3Na$
(19-4)
$C_8H_{17}\phi SO_3Na$
(19-5)
$C_{12}H_{25}\phi SO_3Na$
(19-6)
$C_6H_{13}OCOCH_2CH(C_6H_{13}OCO)SO_3Na$ $\phi$:—$C_6H_4$—

The amount of the additive is preferably in the range of from 0.001 g/m$^2$ to the same amount as the slipping agent (solid content), more preferably from 0.005 g/m$^2$ to half the amount of the slipping agent (solid content).

The above-mentioned slipping agent-containing layer can be prepared by coating and drying a coating solution having the slipping agent dissolved or dispersed in water, or another suitable solvent, on a support, or on a support having other layers coated on its back surface. Alternatively, such layer can also be prepared by coating the coating solution at the time of an emulsion coating.

In order to disperse a slipping agent, use can be made of generally known emulsification dispersion methods, specific examples of which include a method in which a solution of an organic solvent having a slipping agent dissolved therein is emulsified in water; a method in which a slipping agent that was melted at a high temperature is emulsified in water; and a solid dispersion method using a ball-mill or a sand grinder. These emulsification dispersion methods are described in a textbook, such as the *Nyuka.Bunsan Gijutsu Oyo Handbook*, edited by Karigome, Koishi, and Hidaka (published by Science Forum).

Further, various kinds of methods can be used to disperse, in an organic solvent, a slipping agent for use in the present invention. In order to disperse the slipping agent in an organic solvent, use can be made of generally known methods. Specifically, preferred methods are one in which a slipping agent is solid-dispersed in an organic solvent by means of a ball-mill, a sand grinder, and the like; a method in which, first, a slipping agent is dissolved in an organic solvent at an elevated temperature, and then the thus-obtained solution is cooled with stirring, to precipitate and disperse the slipping agent therein; a method in which, first, a slipping agent is dissolved in an organic solvent at an elevated temperature, and then the thus-obtained solution is added to an organic solvent at normal room temperature, or a cooled organic solvent, followed by cooling and precipitation, to disperse the shipping agent therein; and a method in which organic solvents that are immissible with each other are mutually emulsified. Preferred of these methods is one in which, first, a slipping agent is dissolved in an organic solvent at an elevated temperature, and then the thus-obtained solution is added to an organic solvent at normal room temperature, or a cooled organic solvent, followed by cooling and precipitation, to disperse the slipping agent. The organic solvent that is used for this dispersion is not limited in particular, but a cooling solvent to which a solution containing a slipping agent is added is preferably a high polar solvent. Particularly preferable is a method in which a slipping agent is dissolved in a solvent by heating at a temperature of from 60° C. to 150° C., and then the thus-obtained solution is dispersed in a cooling solvent in which the solubility of the slipping agent is not more than 1% at the normal room temperature. Particularly preferred of the solvents in which the solubility of the slipping agent is not more than 1% at normal room temperature, are ketones and alcohols, from the viewpoint of excellent dispersibility. Further, as a disperser that is used for this dispersion, usual stirrers can be used, with an ultrasonic disperser and a homogenizer particularly preferred.

With respect to a diluting solvent for a coating, any kind of solvent may be used, unless the dispersion stability or the solubility of the slipping agent is deteriorated. Preferable examples of these diluting solvents include water, water containing various kinds of surfactants, alcohols (e.g. methanol, ethanol, isopropanol, butanol), ketones (e.g. acetone, methylethylketone, cyclohexane), and esters (e.g. methyl, ethyl, propyl, or butyl esters of acetic acid, formic acid, oxalic acid, maleic acid, or succinic acid).

As particularly preferable typical examples of the silver halide color photographic light-sensitive material of the present invention, color reversal films and color negative films can be mentioned. In particular, general-purpose color negative films are preferable color photographic light-sensitive materials.

Descriptions will be made hereinbelow with reference to general-purpose color negative films.

It is sufficient that the light-sensitive material of the present invention has, on a support, at least one silver halide emulsion layer of a blue-sensitive layer, a green-sensitive layer, or a red-sensitive layer, and there is no particular restriction on the number of silver halide emulsion layers and nonsensitive layers or on the order of these layers. A typical example is a silver halide photographic light-sensitive material having, on a support, at least one photosensitive layer comprising multiple silver halide emulsion layers that have substantially the same color sensitivity but are different in photographic sensitivity, wherein said photosensitive layer is a unit photosensitive layer having color sensitivity to any one of blue light, green light, and red light. In the case of a multilayer silver halide color photographic light-sensitive material, generally the arrangement of unit photosensitive layers is such that a red-sensitive layer, a green-sensitive layer, and a blue-sensitive layer are placed in the stated order from the support side. However, the order of the arrangement may be reversed in accordance with the purpose, and between layers having the same color sensitivity there may be placed a different photosensitive layer.

Known photographic additives that can be used in the present invention are also described in the above-mentioned two Research Disclosures, and involved sections are listed in the same Table below.

| Kind of Additive | RD 17643 | RD 18716 |
|---|---|---|
| 1 Chemical sensitizer | p.23 | p.648 (right column) |
| 2 Sensitivity-enhancing agent | — | p.648 (right column) |
| 3 Spectral sensitizers and Supersensitizers | pp.23–24 | pp.648 (right column)–649 (right column) |
| 4 Brightening agents | p.24 | |
| 5 Antifogging agents and Stabilizers | pp.24–25 | p.649 (right column)– |
| 6 Light absorbents, Filter dyes and Ultraviolet absorbents | pp.25–26 | p.649 (right column)–650 (left column) |
| 7 Stain-preventing agent | p.25 (right column) | p.650 (left to right column) |
| 8 Color image stabilizers | p.25 | |

-continued

| Kind of Additive | RD 17643 | RD 18716 |
|---|---|---|
| 9 Film hardeners | p.26 | p.651 (left column) |
| 10 Binders | p.26 | p.651 (left column) |
| 11 Plasticizers and Lubricants | p.27 | p.650 (right column) |
| 12 Coating aids and Surface-active agents | pp.26–27 | p.650 (right column) |

Further, the patrone system for use in the photographic article may have a structure in which a film is sent out therefrom by rotation of a spur, or a structure in which the end of a film is encased in the body of the patrone, and the end of the film is sent out from a port section of the patrone by a rotation of the spur axis in the same direction. These usual structures are disclosed in U.S. Pat. Nos. 4,834,306 and 5,226,613.

The processed light-sensitive material may be encased in a patrone again. In this case, the patrone to be used may be the same or different from that for use in the unprocessed light-sensitive material.

According to the present invention, a silver halide photographic light-sensitive material having an excellent transparent magnetic recording layer can be provided. The term "excellent" herein referred to means that the problem of emulsion peeling on the same side on which the backing layers are coated is difficult to occur, and further an error in magnetic recording/reproducing caused after a development processing is difficult to occur.

EXAMPLES

The present invention is described in more detail with reference to the following examples, but the present invention is not limited thereto.

Example 1-A

1) Adhesion (subbing) layer

An ultraviolet ray irradiation (UV) treatment was conducted to both surfaces of a polyethylene 2,6-naphthalene dicarboxylate support of 90 μm thickness, by means of a high-voltage mercury lamp that emits a light of 365 nm as a main wavelength, at an irradiation light amount of 1000 mJ/cm$^2$. After that, an adhesion layer having the composition described below was coated on the thus UV-treated support, on the same side as that on which a photographic emulsion layer would be coated (coating amount: 10.4 cc/m$^2$). The ultraviolet ray irradiation was applied according to the method described in the Example of JP-B No. 3828/1970.

| | |
|---|---|
| Gelatin | 10.0 weight parts |
| Distilled water | 12.6 weight parts |
| Salicylic acid | 2.4 weight parts |
| Methanol | 920 weight parts |
| p-Chlorophenol | 105 weight parts |
| Polyamidoepichlorohydrin Resin (produced by Synthesis Example 1 described in JP-A No. 3619/1976) | 0.5 weight parts |

2) First backing layer

In order to form the first backing layer, the same composition as that of the subbing layer was coated.

3) Second backing layer

The term "part" hereinafter referred to means a part by weight.

In 3,000 parts of ethanol, were dissolved 230 parts of stannic chloride hydrate and 23 parts of antimony trichloride, to prepare a uniform solution. To the solution was added, dropwise, a 1N sodium hydroxide aqueous solution, to adjust to a pH of 3, thereby to co-precipitate colloidal stannic oxide and antimony oxide. The thus obtained co-precipitate was allowed to stand at 50° C. for 24 hours, to obtain a reddish brown colloidal precipitate, which was collected by centrifugation.

The solid was washed three times with water by centrifugation, to remove excess ions.

In 1500 parts of water, was re-dispersed 200 parts of the colloidal precipitate that had excess ions removed from it, and the dispersion was atomized into a calcining furnace heated at 500° C., to obtain blue-tinted fine particles of stannic oxide-antimony oxide complex having an average particle size of 0.005 μm and resistivity of 25 Ω·cm.

A mixture of 40 parts of the resulting fine particles and 60 parts of water was adjusted to pH 7.0, coarsely dispersed in a stirrer, and finely dispersed in a horizontal sand mill (Dynomill, manufactured by Willy A. Backfen AG) for a retention time of 30 minutes, to prepare a dispersion in which primary particles were partly condensed to form secondary aggregates having a particle size of 0.05 μm.

A coating solution having the formulation shown below was coated on the support to a dry thickness of 0.3 μm, and the support was dried at 110° C. for 30 seconds.

| Formulation | |
|---|---|
| Dispersion of electrically conductive fine particles above prepared ($SnO_2/Sb_2O_3$, 0.15 μm) | 10 parts |
| Gelatin | 1 parts |
| Water | 27 parts |
| Methanol | 60 parts |
| Resorcin | 2 parts |
| Polyoxyethylene nonylphenyl ether (polymerization degree: 10) | 0.01 part |

4) Third backing layer

To an open kneader, 1100 weight parts of Co-coated $\partial$-$Fe_2O_3$ magnetic substance (manufactured by Toda Industry Co., Ltd., CSF 4085 V2, Hc: 831 Oe, $\sigma_s$: 77.1 emu/g, $\sigma_r$ 37.4 emu/g, $S_{BET}$: 38.7 m$^2$/g), 220 weight parts of water, and 165 weight parts of the silane coupling agent $(CH_3O)_3SiCH_2CH_2CH_2(OCH_2CH_2)_8OCH_3$ (manufactured by Shinetsu Chemical Industry Co., Ltd., X-12-641) were added, and this mixture was well kneaded for 3 hours. The thus coarsely dispersed viscous solution was dried at 70° C. for 24 hrs, to remove water. After that, the resultant dry powder was further subjected to heat treatment at 110° C. for 1 hour, to prepare surface-treated magnetic grains.

Further, a mixture having the following composition was again kneaded in an open kneader for 4 hours:

| | |
|---|---|
| The above-described surface-treated magnetic grains | 855 g |
| Diacetyl cellulose | 25.3 g |
| Methyl ethyl ketone | 136.3 g |
| Cyclohexanone | 136.3 g |

Further, a mixture having the following composition was finely dispersed by means of a sand mill (¼ G), at the rate of 2000 rpm, for 4 hours.

| | |
|---|---|
| The above-described kneaded solution | 45 g |
| Diacetyl cellulose | 23.7 g |

-continued

| | |
|---|---|
| Methyl ethyl ketone | 127.7 g |
| Cyclohexanone | 127.7 g |

Further, a coating solution having the following composition was prepared for the third backing layer.

| | |
|---|---|
| The above-described finely dispersed solution | 21.1 g |
| Diacetyl cellulose | 35.8 g |
| Crosslinking agent [1]: Millionate MR-400 (trade name, manufactured by Nippon Polyurethane Co., Ltd.) | 2.33 g |
| Methyl ethyl ketone | 398.9 g |
| Cyclohexanone | 398.9 g |
| ERC-DBM (α-almina abrasives manufactured by REYNOLDS Co., Ltd. (U.S.A.), average grain size 0.5 μm) | 0.49 g |

The above-mentioned coating solution was coated in a coating amount of 29.3 cc/m$^2$ by means of a wire bar. Drying of the coated layer was performed at 110° C.

5) Fourth backing layer

Preparation of lubricant layer

The first solution, having the following formulation and dissolved by heating at 90° C., was added to the second solution, and the mixture was dispersed by means of a high-pressure homogenizer, to obtain a lubricant undiluted dispersion.

| | |
|---|---|
| First Solution | |
| Compound (16-4) | 0.7 g |
| Compound (18-3) | 1.1 g |
| Xylene | 2.5 g |
| Second Solution | |
| Propyleneglycol monomethyl ether | 34.0 g |

To the above-mentioned lubricant undiluted dispersion was added the following binders and solvents, to prepare a coating solution.

| | |
|---|---|
| Diacetyl cellulose | 3.0 g |
| Acetone | 600.0 g |
| Cyclohexanone | 350.0 g |

The above-described coating solution for a lubricant layer was coated in a coating amount of 10.4 cc/m$^2$.

6) Coating of photosensitive layers

Layers, each having the compositions described below, were multi-coated on a support having on it the above undercoating layers, to prepare samples (multi-layer color light-sensitive materials). (Compositions of Photosensitive Layers)

Main materials used in each layer were classified as follows:

| | |
|---|---|
| ExC: Cyan coupler | UV: Ultraviolet ray absorbent |
| ExM: Magenta coupler | HBS: High-boiling organic solvent |
| ExY: Yellow coupler | H: Gelatin hardening agent |
| ExS: Sensitizing dye | |

Figures corresponding to each component represents the coating amount in terms of g/m$^2$, and for silver halide in terms of silver. With respect to sensitizing dyes, the coating amount is shown in mol per mol of silver halide in the same layer.

(Sample 101)

| | |
|---|---|
| First Layer (Halatation-prevention layer) | |
| Black colloidal silver | silver 0.20 |
| Gelatin | 1.60 |
| ExM-1 | 0.12 |
| ExF-1 | $2.0 \times 10^{-3}$ |
| Solid disperse dye ExF-2 | 0.030 |
| Solid disperse dye ExF-3 | 0.040 |
| HBS-1 | 0.15 |
| HBS-2 | 0.02 |
| Second Layer (Intermediate layer) | |
| Silver bromoiodide emulsion M | silver 0.065 |
| ExC-2 | 0.04 |
| Polyethyl acrylate latex | 0.20 |
| Gelatin | 0.6 |
| Third Layer (Low sensitivity red-sensitive emulsion layer) | |
| Silver bromoiodide emulsion A | silver 0.28 |
| Silver bromoiodide emulsion B | silver 0.07 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.16 |
| ExC-3 | 0.030 |
| ExC-4 | 0.11 |
| ExC-5 | 0.020 |
| ExC-6 | 0.010 |
| Cpd-2 | 0.025 |
| HBS-1 | 0.10 |
| Gelatin | 1.10 |
| Fourth Layer (Medium sensitivity red-sensitive emulsion layer) | |
| Silver bromoiodide emulsion C | silver 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| Cpd-4 | 0.020 |
| HBS-1 | 0.10 |
| Gelatin | 0.80 |
| Fifth Layer (High sensitivity red-sensitive emulsion layer) | |
| Silver bromoiodide emulsion D | silver 0.90 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| Cpd-4 | 0.040 |
| HBS-1 | 0.22 |
| HBS-2 | 0.050 |
| Gelatin | 1.10 |
| Sixth Layer (Intermediate layer) | |
| Cpd-1 | 0.090 |
| Solid disperse dye ExF-4 | 0.030 |
| HBS-1 | 0.050 |
| Polyethyl acrylate latex | 0.15 |
| Gelatin | 1.10 |
| Seventh Layer (Low sensitivity green-sensitive emulsion layer) | |
| Silver bromoiodide emulsion E | silver 0.25 |
| Silver bromoiodide emulsion F | silver 0.20 |
| Silver bromoiodide emulsion G | silver 0.20 |

-continued

| | |
|---|---|
| ExS-4 | $3.0 \times 10^{-5}$ |
| ExS-5 | $1.5 \times 10^{-4}$ |
| ExS-9 | $6.0 \times 10^{-5}$ |
| ExS-6 | $5.0 \times 10^{-4}$ |
| ExS-8 | $3.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Eighth Layer (Medium sensitivity green-sensitive emulsion layer) | |
| Silver bromoiodide emulsion G | silver 0.40 |
| Silver bromoiodide emulsion H | silver 0.35 |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| Cpd-4 | 0.015 |
| HBS-1 | 0.13 |
| HBS-3 | $4.0 \times 10^{-3}$ |
| Gelatin | 0.80 |
| Ninth Layer (High sensitivity green-sensitive emulsion layer) | |
| Silver bromoiodide emulsion I | silver 1.40 |
| ExS-4 | $3.7 \times 10^{-5}$ |
| ExS-5 | $8.1 \times 10^{-5}$ |
| ExS-6 | $3.2 \times 10^{-4}$ |
| ExM-3 | 0.003 |
| ExC-1 | 0.010 |
| ExC-6 | 0.010 |
| ExM-1 | 0.002 |
| ExM-2 | 0.010 |
| ExM-4 | 0.010 |
| ExM-6 | 0.010 |
| ExM-5 | 0.010 |
| Cpd-4 | 0.030 |
| Cpd-3 | 0.040 |
| HBS-1 | 0.25 |
| Polyethyl acrylate latex | 0.15 |
| Gelatin | 1.33 |
| Tenth Layer (Yellow filter layer) | |
| Yellow colloidal silver | silver 0.015 |
| Cpd-1 | 0.16 |
| Solid disperse dye ExF-5 | 0.060 |
| Solid disperse dye ExF-6 | 0.060 |
| Oli-soluble dye ExF-7 | 0.010 |
| HBS-1 | 0.60 |
| Gelatin | 0.60 |
| Eleventh Layer (Low sensitivity blue-sensitive emulsion layer) | |
| Silver bromoiodide emulsion J | silver 0.10 |
| Silver bromoiodide emulsion K | silver 0.20 |
| Silver bromoiodide emulsion N | silver 0.10 |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
| Twelfth Layer (High sensitivity blue-sensitive emulsion layer) | |
| Silver bromoiodide emulsion L | silver 0.40 |
| ExS-7 | $4.0 \times 10^{-4}$ |
| ExY-2 | 0.10 |

-continued

| | |
|---|---|
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| Thirteenth Layer (First protective layer) | |
| Silver bromoiodide emulsion M | silver 0.10 |
| UV-1 | 0.19 |
| UV-2 | 0.075 |
| UV-3 | 0.065 |
| ExF-8 | 0.010 |
| ExF-9 | 0.020 |
| ExF-10 | 0.002 |
| ExF-11 | 0.002 |
| HBS-1 | $5.0 \times 10^{-2}$ |
| HBS-4 | $5.0 \times 10^{-2}$ |
| Gelatin | 1.8 |
| Fourteenth Layer (Second protective layer) | |
| H-1 | 0.40 |
| B-1 (diameter: 2.1 μm) | 0.06 |
| B-2 (diameter: 2.2 μm) | 0.09 |
| B-3 | 0.13 |
| S-1 | 0.20 |
| Gelatin | 0.70 |
| Fifteenth Layer | |
| Polyacrylamide (molecular weight 45,000) | 0.02 g/m$^2$ |
| Dextran (molecular weight 38,000) | 0.02 g/m$^2$ |
| Poly(sodium acrylate) (molecular weight 90,000) | 0.02 g/m$^2$ |
| Poly(sodium stylenesulfonate) (molecular weight 50,000) | 0.02 g/m$^2$ |
| Hydroxypropyl cellulose (molecular weight 100,000) | 0.02 g/m$^2$ |
| Colloidal silica (av. particle diameter: 25 nm) | 0.15 g/m$^2$ |
| Silica (av. particle diameter: 0.3 μm) | 0.02 g/m$^2$ |
| Silica (av. particle diameter: 2.0 μm) | 0.02 g/m$^2$ |
| Aluminum oxide (av. particle diameter: 1.0 μm, indeterminate form) | 0.01 g/m$^2$ |
| Sodium bis(2-ethylhexyl)α-sulfosuccinate | 0.01 g/m$^2$ |
| Sodium dodecylbenzenesulfonate | 0.01 g/m$^2$ |
| Sodium p-t-octylphenoxyethoxyethoxyethane-sulfonate | 0.01 g/m$^2$ |
| $C_8F_{17}SO_3Na$ | 0.005 g/m$^2$ |
| $C_8F_{17}SO_2N(C_3H_7)CH_2COOK$ | 0.005 g/m$^2$ |
| $C_8F_{17}SO_2N(C_3H_7)$—$(CH_2CH_2O)_4$—$(CH_2)_4$—$SO_3Na$ | 0.005 g/m$^2$ |
| $C_8F_{17}SO_2NHCH_2CH_2N^+(CH_3)_3.I^-$ | 0.005 g/m$^2$ |
| $C_8F_{17}SO_2NHCH_2CH_2O$—$(CH_2)_3$—$N^+(CH_3)_3.P.CH_3$—$C_6H_4$—$SO_3^-$ | 0.005 g/m$^2$ |
| $C_8F_{17}SO_2NHCH_2CH_2N^+(CH_3)_2$—$CH_2COO^-$ | 0.005 g/m$^2$ |
| $C_8F_{17}SO_2NHCH_2CH_2N^+(CH_3)_2$—$CH_2SO_3^-$ | 0.005 g/m$^2$ |
| $C_8H_{17}CH_2CH_2O$—$(CH_2CH_2O)_{10}$—H | 0.005 g/m$^2$ |
| $C_8F_{17}SO_2N(C_3H_7)$—$(CH_2CH_2O)_{16}$—H | 0.005 g/m$^2$ |
| $C_{16}H_{33}O$—$(CH_2CH_2O)_{10}$—H | 0.005 g/m$^2$ |
| Poly(polymerization degree: 7) glyceryl p-octyl-phenyl ether | 0.005 g/m$^2$ |
| Cetyl palmitate (dispersion dispersed in water with sodium dodecylbenzenesulfonate) | 0.03 g/m$^2$ |
| Dimethylsiloxane (molecular weight 1000; viscosity 10 cs (25° C.); emulsion emulsified in gelatin that was dispersed in water with sodium dodecyl-benzenesulfonate; av. particle diameter 0.08 μm) | 0.11 g/m$^2$ |
| Liquid paraffin (emulsion emulsified in gelatin that was dispersed in water with sodium bis (2-ethyhexyl)α-sulfosuccinate; av. particle diameter 0.09 μm) | 0.02 g/m$^2$ |
| $C_{50}H_{101}O$—$(CH_2CH_2O)_{16}$—H (this was, first, melted in hot water at 100° C., and then cooled to 10° C., to obtain as a precipitation dispersion; av. particle diameter 15 nm) | 0.01 g/m$^2$ |
| Potassium nitrate | 0.01 g/m$^2$ |
| Poly(ethyl acrylate)latex (av. particle diameter: 0.06 μm) | 0.15 g/m$^2$ |

Further, in order to improve preservability, processability, pressure resistance, antimold and antibacterial properties, antistatic property, and coating property, compounds of W-1 to W-3, B-4 to B-6, and F-1 to F-17, and salts of iron, lead, gold, platinum, palladium, iridium, and rhodium were suitably added in each layer.

Details of emulsions used in this Example are shown in Table 1.

TABLE 1

| | Average AgI Content (%) | Deviation Coefficient in AgI Content among Grains (%) | Mean Grain Size Spherically Equivalent Size (μm) | Deviation Coefficient in Grain Size (%) | Projected Area Diameter Circular Equivalent Size (μm) | Ratio of Diameter/ Thickness |
|---|---|---|---|---|---|---|
| Emulsion A | 3.7 | 15 | 0.37 | 14 | 0.43 | 2.5 |
| B | 3.7 | 15 | 0.43 | 19 | 0.58 | 3.5 |
| C | 5.0 | 18 | 0.55 | 20 | 0.85 | 7.0 |
| D | 5.4 | 20 | 0.66 | 20 | 1.10 | 7.0 |
| E | 3.7 | 15 | 0.37 | 14 | 0.43 | 2.5 |
| F | 3.7 | 15 | 0.43 | 19 | 0.58 | 3.5 |
| G | 5.4 | 18 | 0.55 | 20 | 0.85 | 7.0 |
| H | 5.4 | 20 | 0.66 | 21 | 1.10 | 7.0 |
| I | 5.4 | 20 | 0.72 | 22 | 1.17 | 7.0 |
| J | 3.7 | 15 | 0.37 | 15 | 0.50 | 4.5 |
| K | 8.8 | 18 | 0.64 | 23 | 0.85 | 5.2 |
| L | — | 25 | 0.89 | 24 | 1.29 | 6.8 |
| M | 1.0 | — | 0.07 | 15 | — | 1.0 |
| N | 3.7 | 15 | 0.37 | — | — | 4.5 |

In Table 1, (1) Emulsions J to L and N were subjected to a reduction sensitization using thiourea dioxide and thiosulfonic acid at preparation of grains, according to the Example described in JP-A No. 191938/1990.

(2) Emulsions A to I were subjected to a gold sensitization, a sulfur sensitization, and a selenium sensitization under the presence of respective sensitizing dyes described in each layer and sodium thiocyanate, according to the Example described in JP-A No. 237450/1991.

(3) At the preparation of tabular grains, low-molecular-weight gelatin was used according to the Example described in JP-A No. 158426/1989.

(4) Tabular grains were observed a rearrangement line by a high-pressure electron microscope, as described in JP-A No. 237450/1991. Preparation of a dispersion of organic solid disperse dye ExF-2 illustrated hereinunder was dispersed in the manner as described below.

Into 700-ml pot mill, were placed 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether having a degree of polymerization of 10, followed by addition of 5.0 g of the dye ExF-2 and 500 ml of zirconium oxide beads having a diameter of 1 mm. The resulting mixture was dispersed for 2 hrs. The dispersion was conducted by means of a BO-type vibration ball mill, manufactured by Chuo-Koki Co. After the dispersion, the content was recovered, and added into 8 g of 12.5% aqueous gelatin solution. Then the beads were removed by filtration, and a gelatin dispersion of the dye was obtained. The mean grain size of the fine grains of dye was 0.44 μm.

Dispersions of ExF-3, ExF-4, and ExF-6 in the form of solid fine grains were obtained in the same manner as above. Mean grain sizes of the fine grains of dye were 0.24 μm, 0.45 μm and 0.52 μm, respectively.

ExF-5 was dispersed by the microprecipitation dispersion method as described in Example 1 of EP No. 549,489A. A mean grain size of the fine grains of ExF-5 was 0.06 μm.

Further, compounds such as couplers and a variety of additives for use in this light-sensitive material are shown below.

ExC-1

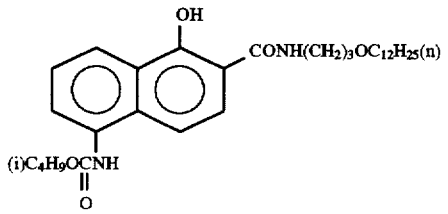

-continued
ExC-2
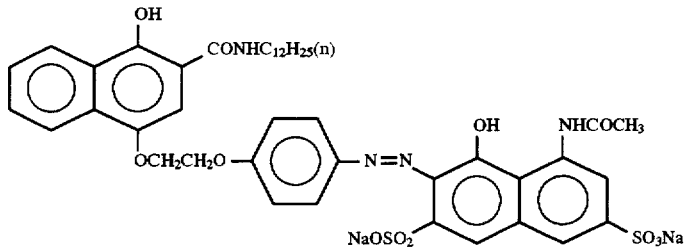
ExC-3
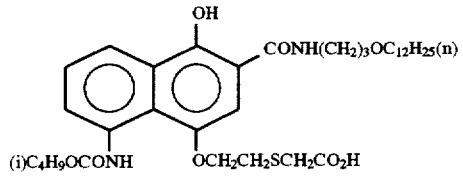
ExC-4
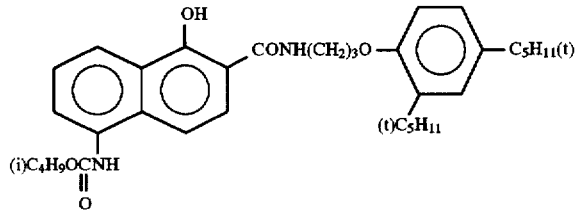
ExC-5
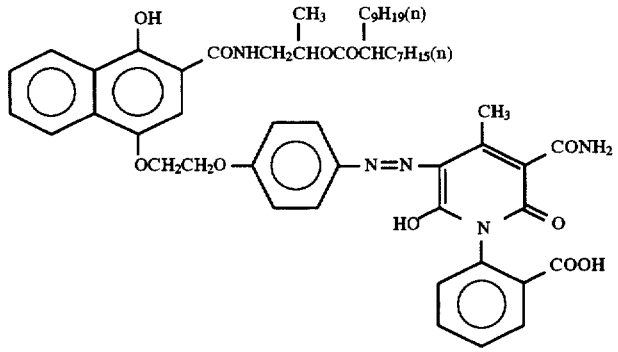
ExC-6
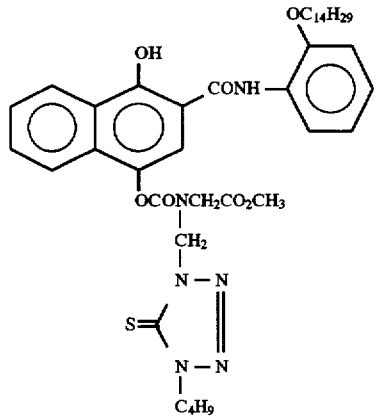
ExC-7
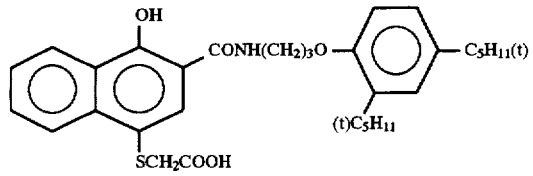

-continued
ExC-8
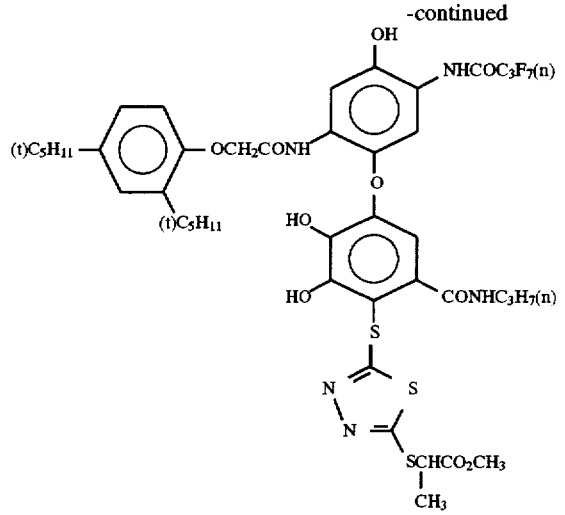
ExM-1
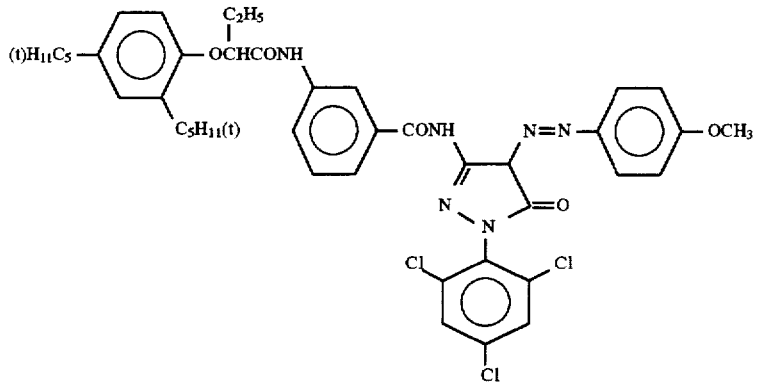
ExM-2
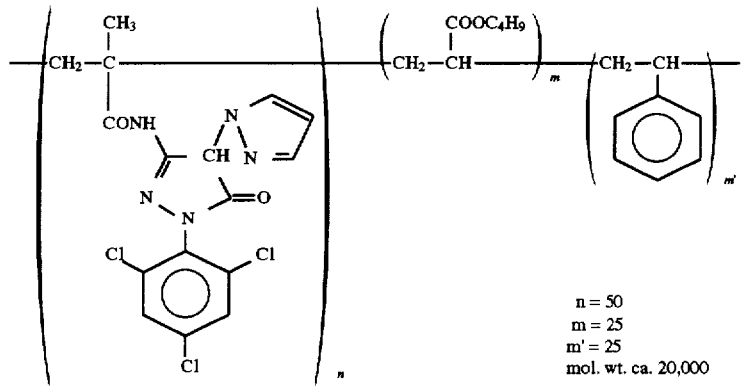
ExM-3
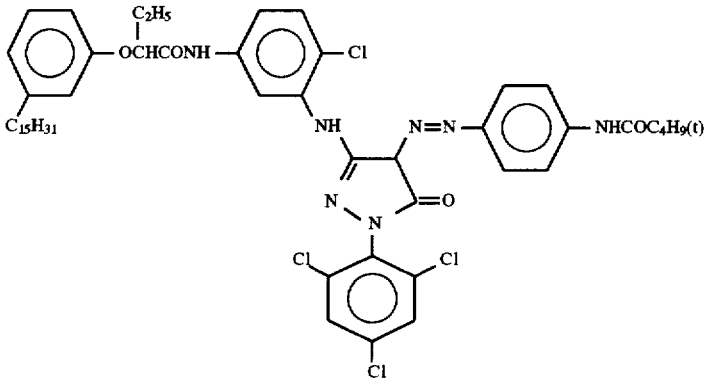

-continued
ExM-6
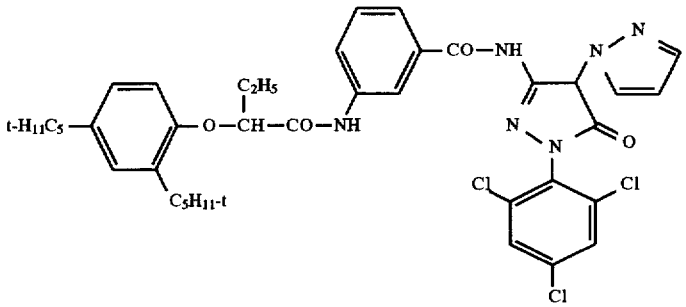
ExM-4
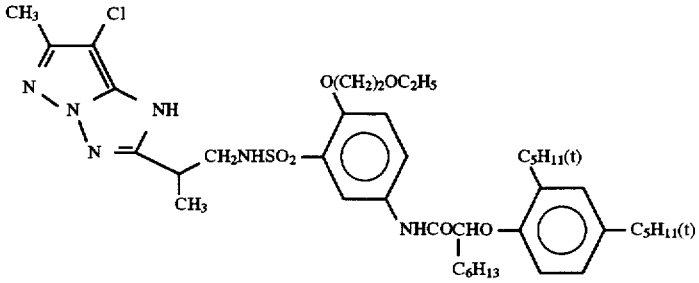
ExM-5
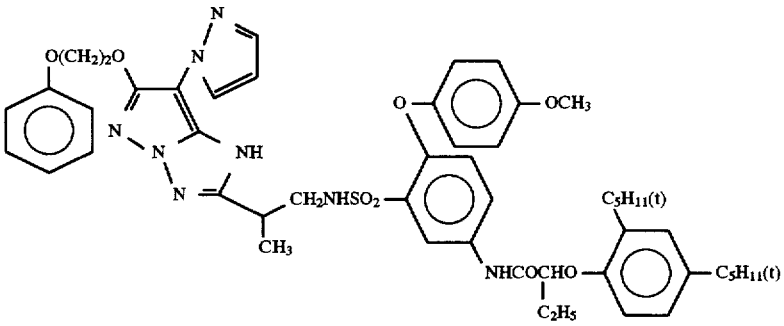
ExY-1
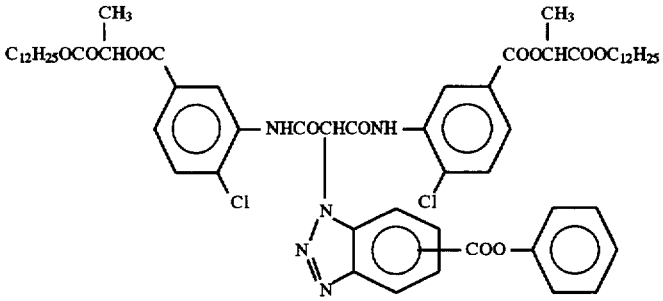
ExY-2
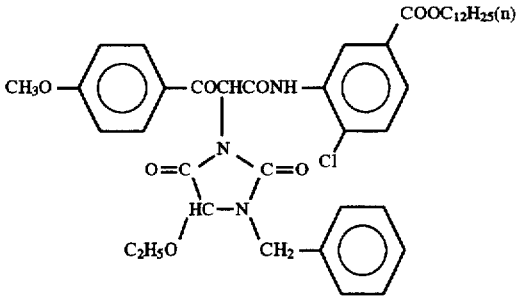

-continued
ExY-3
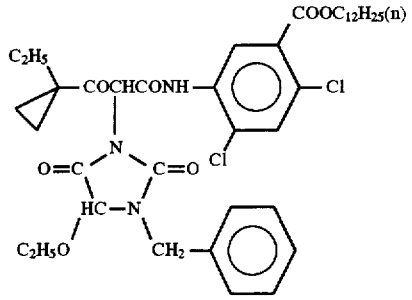
ExY-4
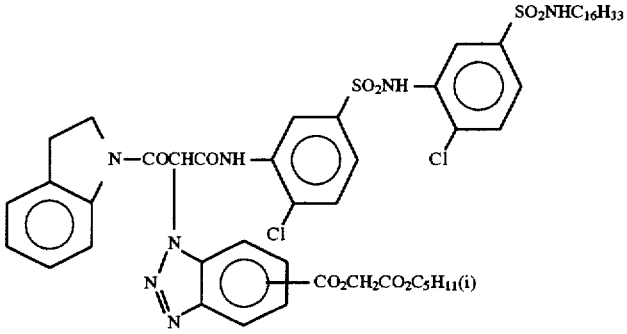
ExY-5
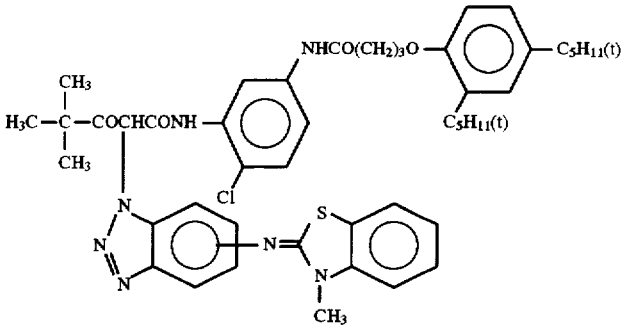
ExF-1
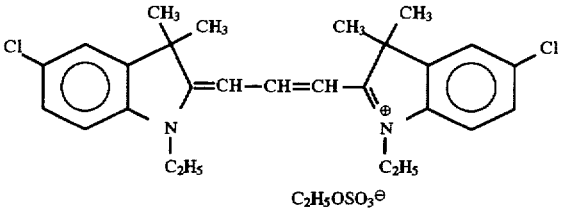
ExF-2
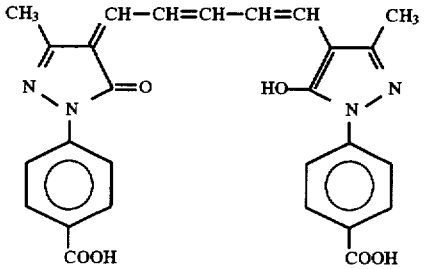
ExF-3
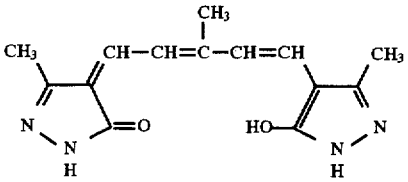

-continued
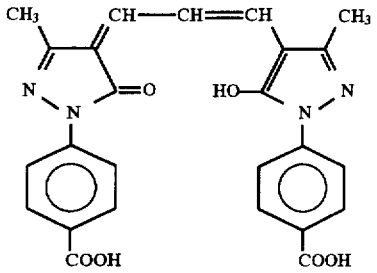
ExF-4
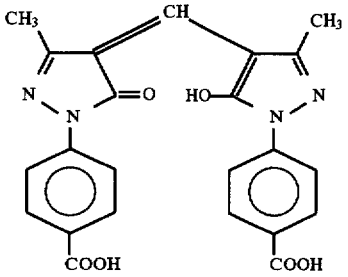
ExF-5
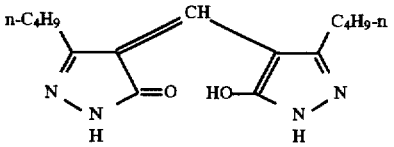
ExF-6
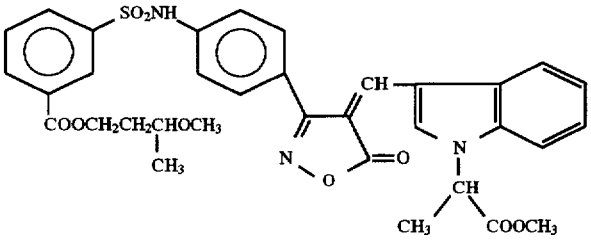
ExF-7
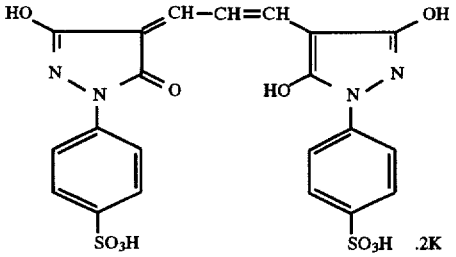
ExF-8
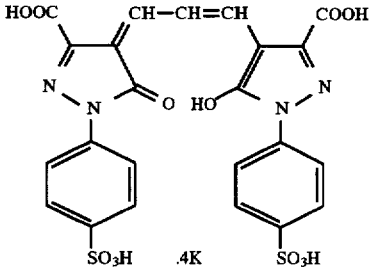
ExF-9

-continued
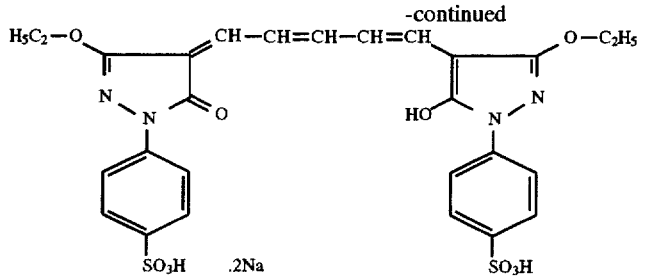
ExF-10
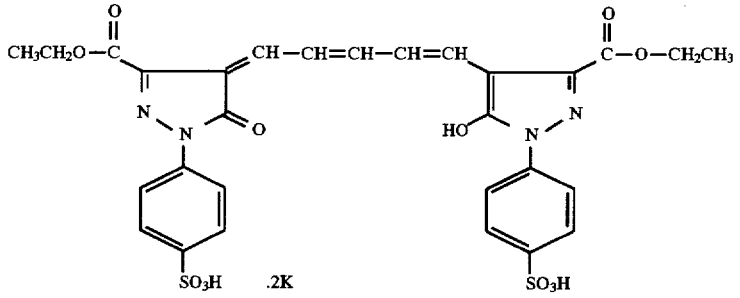
ExF-10
Cpd-1
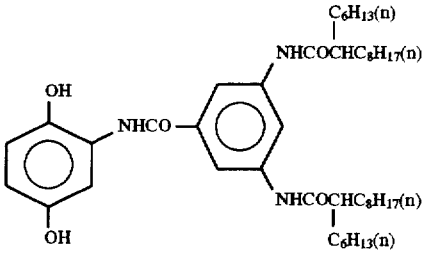
Cpd-2
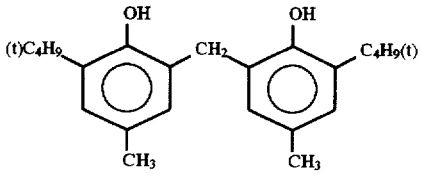
Cpd-3
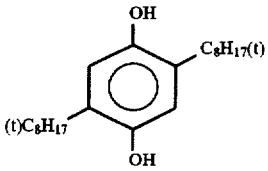
Cpd-4
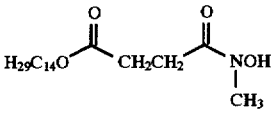
UV-1
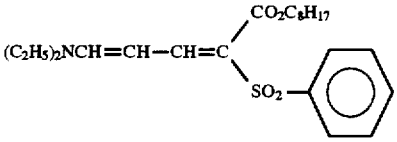
UV-2
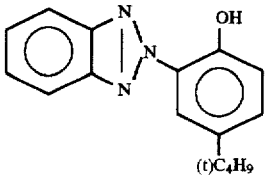

-continued
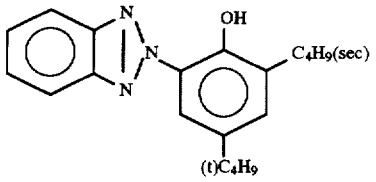
UV-3
Tricresyl phosphate — HBS-1
Di-n-butyl phthalate — HBS-2
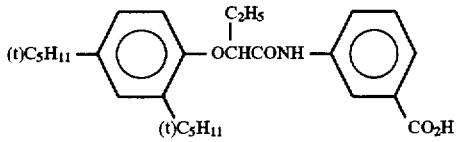
HBS-3
Tri(2-ethylhexyl) phosphate — HBS-4
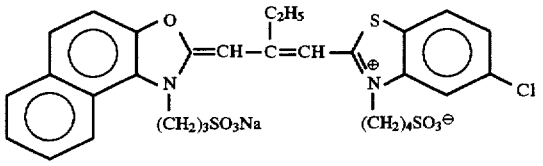
ExS-1
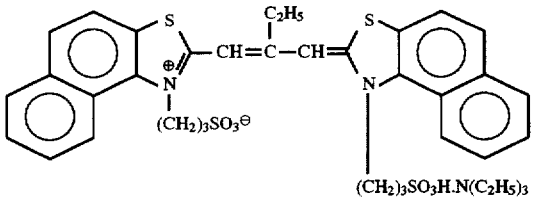
ExS-2
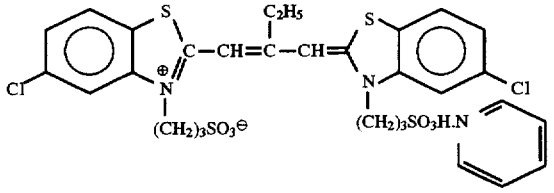
ExS-3
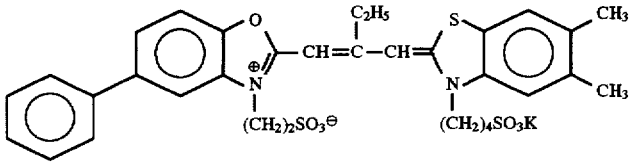
ExS-4
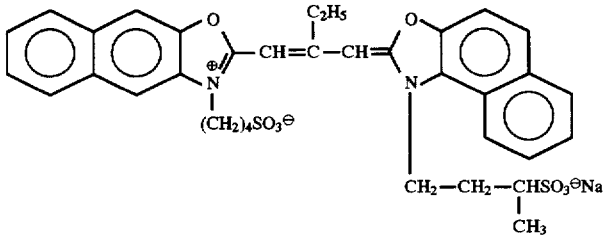
ExS-5
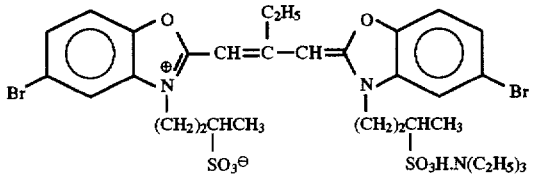
ExS-6

-continued
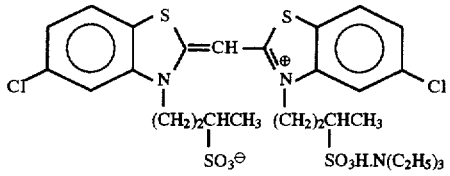
ExS-7
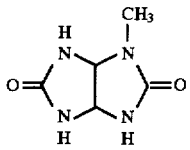
S-1
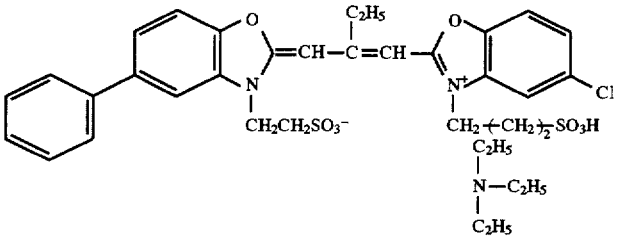
ExS-8
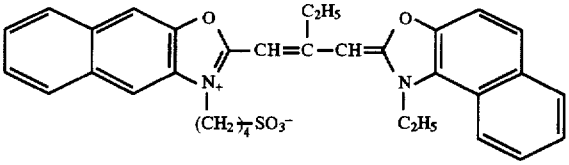
ExS-9
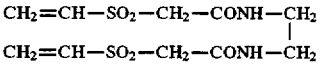
H-1
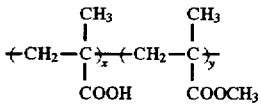
x/y = 10/90
av. particle diameter 2.1 μm
B-1
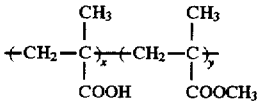
x/y = 45/55
av. particle diameter 2.2 μm
B-2
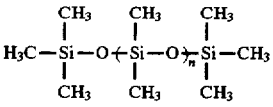
B-3
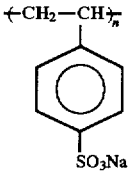
B-4
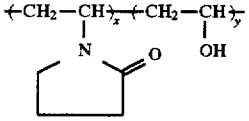
x/y = 70/30
B-5
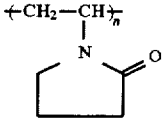
(mol. wt. ca. 10,000)
B-6

-continued
W-1
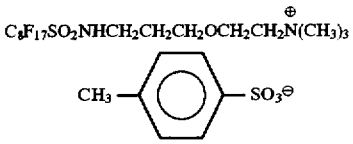
W-2
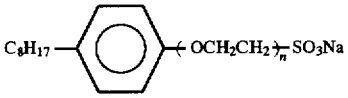
n = 2–4
W-3
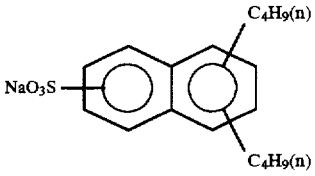
F-1
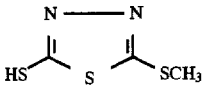
F-2
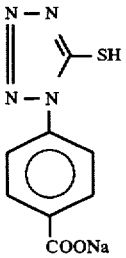
F-3
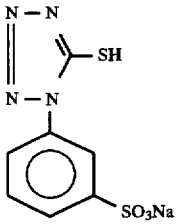
F-4
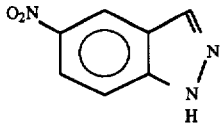
F-5
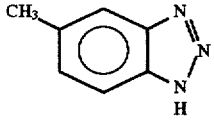
F-6
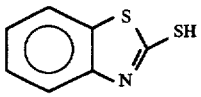
F-7
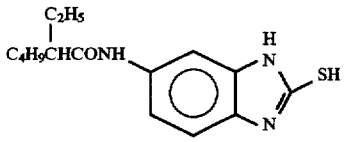

-continued

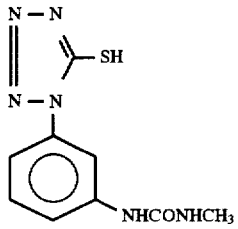

F-8

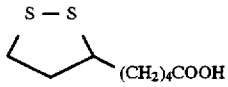

F-9

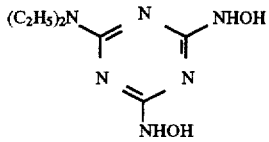

F-10

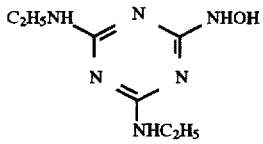

F-11

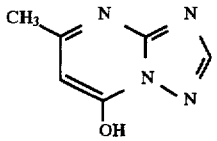

F-12

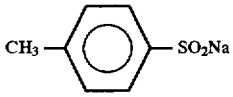

F-13

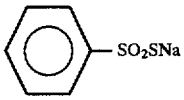

F-14

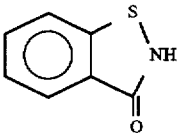

F-15

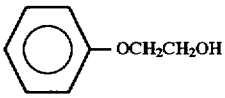

F-16

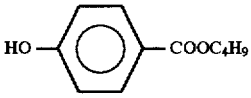

F-17

7) Development processing of photographic film

Thus obtained photographic film was subjected to the following development processing.

As a processor, cine-type Autoprocessor FNCP-900 manufactured by Fuji Photo Co., Ltd., was used.

The development process of these samples was as followed:

| Processing step | Time |
|---|---|
| Color developing | 3 min 15 sec |
| Bleaching | 6 min 30 sec |
| Water washing | 2 min 10 sec |
| Fixing | 4 min 20 sec |
| Water washing | 3 min 15 sec |
| Stabilizing | 1 min 05 sec |

The composition of each processing solution is as followed, respectively:

| Color-developer | |
|---|---|
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 g |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.0 |
| **Bleaching solution** | |
| Iron (III) ammonium ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| **Fixing solution** | |
| Disodium ethylenediaminetetraacetate | 1.0 g |
| Sodium sulfite | 4.0 g |
| Aqueous ammonium thiosulfate solution (70%) | 175.0 g |
| Sodium bisulfite | 4.6 g |
| Water to make | 1.0 liter |
| pH | 6.6 |
| **Stabilizing solution** | |
| Formalin (40%) | 2.0 ml |
| Polyoxyethylene-p-monononylphenyl ether (average polymerization degree: 10) | 0.3 g |
| Water to make | 1.0 liter |

Further, the same procedure as in Example 1-A was repeated, except that the addition amount of the crosslinking agent [1] was changed, as shown in Table 2 (Example 1-B to I).

Evaluation of the thus-prepared samples is described below.

a) Evaluation of electric conductivity

A resistance measuring instrument was connected to the edge of a film of 1 cm width, and its resistance was measured. The measurement (evaluation) was performed at 25° C. and 10% RH.

b) Evaluation of durability (adhesiveness among layers: emulsion peeling) - part 1 -

Photographic emulsion layers were removed from the light-sensitive material (film). After that, carvings were applied onto the back surface of the light-sensitive material by means of a commercial-market single-edge blade, so that 25 squares of 3 mm×3 mm were formed in an area measuring 15 mm×15 mm. The depth of the carvings was 1 μm from the back surface so that the carvings would not reach the base. A commercial-market sticky tape was applied onto the carved back surface, and then the tape was pressed all over the said area measuring 15 mm×15 mm. After a lapse of 20 min, this sticky tape was removed suddenly at a single stroke. As a result, emulsion-peeled portions that adhered to the sticky tape were removed from the film.

Based on 25 squares, samples were classified into the following three grades:

| Samples | Grade |
|---|---|
| No squares were peeled | ○ |
| One to five squares were peeled | Δ |
| More than 5 squares were peeled | x |

c) Evaluation of durability (adhesiveness among layers: emulsion peeling) - part 2a -

A fresh film of width 24 mm and length 1.5 m was previously subjected to a magnetic recording by means of FM signals of 6 KHz, while conveying the film at the rate of 100 mm/sec, and then the film was subjected to a development processing. After that, the recorded signals were reproduced by means of a widely used type of magnetic reproduction head, having a gap of 5 μm and a winding number of 2000 turns, using an amplifier that has a gain of about 95 dB. According to the above-mentioned method, an average magnitude of the reproduced signals of the 200th pass was measured, compared to that of the 1st pass, to evaluate emulsion peeling. With respect to the films that are poor in quality on emulsion peeling, their magnetic recording layer and other layers are easily scratched and peeled off, and consequently the reproduced signals of the 200th pass reduce, compared to that of the 1st pass.

According to the following equation, samples were classified into three grades:

S(200/1)=[Average magnitude of reproduced signals of the 200th pass] / [Average magnitude of reproduced signals of the 1st pass]×100 (%)

| Sample | Grade |
|---|---|
| S(200/1) was less than 90% | x |
| S(200/1) was not less than 90%, but less than 95% | Δ |
| S(200/1) was not less than 95% | ○ |

Further, both edges on the back surface of the processed film were observed using an optical microscope, to thoroughly examine for the presence of even a very small amount of emulsion peeling. - part 2b -

| Sample | Grade |
|---|---|
| No emulsion peeling was observed | ○ |
| Emulsion peeling was observed by means of an optical microscope | Δ |
| Emulsion peeling was clearly observed by examination with the naked eye | x |

d) Evaluation of magnetic recording/reproduction after the processing

A sample, having been slit to size 24 mm width and 200 m length (flesh film), was previously subjected to magnetic recording by means of FM signals of 6 KHz, while conveying the film at the rate of 100 mm/sec, and then the recorded signals were reproduced by means of a widely used type of magnetic reproduction head, having a gap of 5 μm and a winding number of 2000 turns, using an amplifier that has a gain of about 95 dB, in order to measure an average magnitude of the reproduced signals (at this time, it was confirmed that no "error in recording" arose). After that, the film was subjected to a development processing, and then the magnitude of the reproduced signals was measured in the same manner as described above. But, at this time, each of the reproduced signals was examined as described below, to evaluate the magnetic recording/reproduction after the development processing.

The more stain consisting of ingredients contained in a developing solution is stuck to the back surface of a light-sensitive material, the more the stain is transferred to the surface of a magnetic head. The dropout frequency was used to evaluate the magnetic recording/reproduction after the development processing, since a magnitude of amplitude of signal becomes small owing to a loss of the space, so that the dropout frequency increases.

The term "dropout" herein referred to is defined as follows: When a magnitude of each of the reproduced signals has become 35% or less, compared to an average magnitude of the reproduced signals of a fresh film, "dropout" has occurred.

| | |
|---|---|
| When dropout occurred 10 or more times | x |
| When dropout occurred 5 or more times, but less than 10 times | Δ |
| When dropout occurred 1 or more times, but less than 5 times | ○ |
| When no dropout occurred | ◎ |

Samples of Example 1-A to 1-I were each found to exhibit excellent antistatic capability, since each's electric conductivity was $3.5\times10^9$ Ω in terms of resistance at 25° C. and 10% RH.

EXAMPLE 2

As is shown in Table 2, a sample was prepared in the same manner as the sample of Example 1-A, except that the abrasives (ERC-DBM) composed of $\alpha$-$Al_2O_3$ was removed from the third backing layer in Example 1-A. This sample was designated as the sample of Example 2-A. Further, a sample was prepared in the same manner as the sample of Example 1-A, except that the abrasive ERC-DMB, which was used in Example 1-A, was replaced by 1.2 g of Nouton E-600 (trade name, manufactured by Nouton Co. Ltd. (U.S.A.); average grain size 0.4 μm). This sample was designated as the sample of Example 2-B. With respect to the samples of Example 1-A and 2-B, sharp projections were formed on the surface of the backing layer by the addition of the abrasives, which caused a remarkable effect that dust, having been caught up and staying on the surface of a magnetic head, and stain, consisting of ingredients of a processing solution, were removed. Further, and an effect on cleaning of the magnetic head surface was outstanding. Consequently, the dropout of the reproduced signal was extremely difficult to occur. On the other hand, with respect to the sample of Example 2-A, containing no abrasives, the dropout frequency of the reproduced signal increased. Therefore, by the incorporation of abrasives in the backing layer of the light-sensitive material, in addition to the effect obtained by the crosslinking agent for use in the present invention, a photographic light-sensitive material having an excellent transparent magnetic recording layer can be provided. The provided light-sensitive material of the present invention does not cause emulsion peeling, and is imparted a sufficient magnetic recording/reproduction ability after development processing.

TABLE 2

| Sample No. | Used cross-linking agent | Coated amount (mg/m²) | Evaluation of durability on emulsion peeling Part 1 | Part 2a | Part 2b | Evaluation of magnetic recording/reproduction after the development processing (number of dropout) | Remarks |
|---|---|---|---|---|---|---|---|
| Example 1-A | Crosslinking agent 1 | 70 | ○ | ○ | ○ | ○ | This invention |
| Example 1-B | " | 0 | X | X | X | Evaluation could not be conducted, due to emsulsion peeling. | Comparative example |
| Example 1-C | " | 3 | Δ | Δ | ○ | ○ | This invention |
| Example 1-D | " | 20 | ○ | Δ | ○ | ○ | This invention |
| Example 1-E | " | 100 | ○ | ○ | ○ | ○ | This invention |
| Example 1-F | " | 250 | ○ | ○ | ○ | ○ | This invention |
| Example 1-G | " | 750 | ○ | ○ | ○ | ○ | This invention |
| Example 1-H | " | 1000 | ○ | ○ | ○ | ○ | This invention |
| Example 1-I | " | 1200 | ○ | ○ | ○ | X | Comparative example |
| Example 2-A | " | 70 | ○ | ○ | ○ | X | Comparative example |
| Example 2-B | " | 70 | ○ | ○ | ○ | ○ | This invention |

As is shown in Table 2, both emulsion peeling and the error in magnetic recording/reproduction after the development processing were prevented by coating the crosslinking agent for use in the present invention in an amount of from 3 mg/m² to 1000 mg/m². As a result, a silver halide photographic light-sensitive material having an excellent transparent magnetic recording layer was prepared. On the other hand, when the crosslinking agent was added in an amount of more than 1000 mg/m², the error in magnetic recording/reproduction after the processing could not be reduced to the no-problem level, even though the crosslinking agent according to the present invention was used. Further, when the crosslinking agent was added in an amount of less than 3 mg/m², emulsion peeling could not be prevented, even though the crosslinking agent for use in the present invention was used.

EXAMPLE 3

The same operation was repeated in the same manner as in Example 1, except that diacetyl cellulose, as a binder in the third backing layer, was completely replaced by either cellulose acetate propionate or nitrocellulose. Consequently, the similar results as in Example 1 were obtained.

EXAMPLE 4

The same operation was repeated in the same manner as in Example 1-A, except that one of 1,4-diazabicyclo[2,2,2] octane, dibutyltin dilaurate, or 1,8-diaza-bicyclo[5,4,0] undecene-7 was further added to the third backing layer, in an amount of 0.02 g/m$^2$. As a result, for the sample containing the above-listed compound, emulsion peeling was directly improved without a redrying, whereas for the sample of Example 1-A containing none of the above-listed compounds, a crosslinking reaction progressed by a redrying at 110° C. for 3 min, whereby emulsion peeling was improved. Accordingly it was found that by incorporating at least one of the above-listed tertiary amines, metal salts, and DBU compounds into a backing layer, the speed of improvement in emulsion peeling is accelerated, and a load of drying is further reduced, whereby latitude in the production steps is widened.

EXAMPLE 5

A sample was prepared in the same manner as in Example 1-A, except that, after the first backing layer and the second backing layer were coated on the support, in this order, the thus-coated support was rolled on a stainless reel of 20 cm diameter, and then it was subjected to a heat treatment, to give thermal history thereto, at 110° C. (Tg of the PEN support: 119° C.) for 48 hrs, and then the subbing layer, the third backing layer, and the fourth backing layer were further coated on the support. This sample was designated as the sample of

EXAMPLE 5-A.

Further, the samples of Example 1-A and Example 5-A were rolled (encased) in a cartridge, disclosed in JP-A No. 115251/1992 (U.S. Pat. No. 5,226,613), and then they were subjected to a thermal test under the environmental condition of a film that is left in a car in the summer season, i.e. 80° C. for 2 hrs. As a result, the sample of Example 1-A formed a core-set curl, and its conveyance in a processor was difficult, so that the sample easily became scratched. In contrast, the sample of Example 5-A formed almost no core-set curl. Therefore, according to the present invention, a very excellent light-sensitive material was obtained, from such points of view as not only effects on improvement in emulsion peeling and dropout after development processing, but also an effect on reduction in the frequency of being scratched by a processor.

EXAMPLE 6

A sample was prepared in the same manner as in Example 1-A, except that water was used in place of a dispersion of electrically conductive fine grains in the second backing layer. This sample was designated as the sample of Example 6-A. Further, another sample was prepared in the same manner as in Example 1-A, except that the second backing layer was omitted, and in place thereof, an additional layer having the same composition as the second backing layer was coated between a subbing layer on the same side on which a photographic emulsion layer be coated, and the photographic emulsion layers. This sample was designated as the sample of Example 6-B. Further, another sample was prepared in the same manner as in Example 1-A, except that an additional layer having the same composition as the second backing layer was further coated between a subbing layer on the same side on which a photographic emulsion layer be coated, and the photographic emulsion layer. This sample was designated as the sample of Example 6-C. Samples of Example 1-A, 6-B, and 6-C were each found to exhibit excellent antistatic capability, since each's electric conductivity was $10^{10}$ or less in terms of resistance at 25° C. and 10% RH. On the other hand, when $SnO_2/Sb_2O_5$ (antistatic agent) was not added to the backing layer, as in the sample of Example 6-A, its resistance was not less than $10^{15}$, and consequently static marks considerably occurred at the time of handling, which resulted in poor image quality. Therefore, in the present invention, a considerably excellent light-sensitive material can be provided by addition of an antistatic agent thereto.

EXAMPLE 7

A sample was prepared in the same manner as in Example 1-A, except that the slipping agents (Compound 16-4 and Compound 18-3) in the fourth backing layer were omitted. This sample was designated as the sample of Example 7-A. The slipping property of the back surface of the sample of Example 1-A was not more than 0.09, in terms of a coefficient of kinematic friction, weighted by 100 g of stainless steel balls, each having a diameter of 0.5 cm, and at the rate of 60 cm/min. In contrast, with respect to the sample of Example 7-A, whose backing layer contained no slipping agent, its coefficient of kinematic friction was 0.45, and therefore its slipping property was very poor. Consequently, the frequency of the sample being scratched by machine parts in a processor increased, because of poor conveyance in the processor. Accordingly, a further excellent light-sensitive material can be provided by incorporating a slipping agent in a backing layer.

EXAMPLE 8

A sample was prepared in the same manner as in Example 1-A, except that 0.65 g of a spherical matting agent, consisting of $SiO_2$ (Trade name, Seahostar KE-P50, manufactured by Nippon Shokubai Co., Ltd.; average grain size, 0.5 μm), was further added to the third backing layer. This sample was designated as the sample of Example 8-A. With the sample of Example 8-A, an irregularity on the back surface of the light-sensitive material was formed by the addition of the matting agent. Consequently, the dropout frequency in the signal of reproduction further decreased in this sample, since the thus-formed irregularity further kept stain that had adhered onto the surface of the backing layer at the time of processing, from being transferred to the surface of the magnetic head. Accordingly, incorporating a matting agent in a backing layer of the light-sensitive material can provide a photographic light-sensitive material having a transparent magnetic recording layer that imparts an excellent magnetic reproduction capability.

EXAMPLE 9

Similar to the sample of Example 5-A, the sample of Example 9-A was prepared as described below.

Both surfaces of a polyethylene 2,6-naphthalene dicarboxylate support of 90 μm thickness were subjected to a glow-discharge treatment under the following conditions: atmospheric pressure in the treatment, 0.2 Torr; partial pressure of $H_2O$ in the atmospheric gas, 75%; discharge frequency, 30 KHz; output, 2500 W; and treatment strength, 0.5 kV•A•min/m$^2$.

Onto this support, omitting the first backing layer, was coated a coating solution having the composition described below, as the second backing layer, in a coating amount of 5 cc/m$^2$, using the bar-coating method described in JP-B No. 4589/1983. The second baking layer was the backing layer that was applied at first, among backing layers.

| | |
|---|---|
| Dispersion of electrically conductive fine grains (10% aqueous dispersion of $SnO_2/Sb_2O_5$ grains. Secondary aggregates (average grain size, 0.05 μm) comprising primary grains having a grain size of 0.005 μm) | 50 weight parts |
| Gelatin | 0.5 weight parts |
| Water | 49 weight parts |
| Polyglycerol polyglicidyl ether | 0.16 weight parts |
| Polyoxyethylene sorbitan monolaurate (polymerization degree, 20) | 0.1 weight parts |

Further, the PEN support having thereon the second backing layer was rolled on a stainless reel of 20 cm diameter, and then it was subjected to a heat treatment at 110° C. (Tg of the PEN support, 119° C.) for 48 hrs, to give a thermal history thereto. After that, a coating solution having the composition described below was coated on the surface of the support, as a subbing layer, in an amount of 10 cc/m$^2$, using the bar-coating method.

| | |
|---|---|
| Gelatin | 1.01 weight parts |
| Salicylic acid | 0.30 weight parts |
| Resorcin | 0.40 weight parts |
| Poly(polymerization degree, 10)oxyethylenenonyl phenyl ether | 0.11 weight parts |
| Water | 3.53 weight parts |
| Methanol | 84.57 weight parts |
| n-Propanol | 10.08 weight parts |

Further, the third backing layer, the fourth backing layer, and finally photographic emulsion layers were coated in the same manner as in the sample of Example 1-A, to prepare the sample of Example 9-A.

It was found that the present sample of Example 9-A, as well as the sample of Example 5-A, was an excellent photographic film hardly causing emulsion peeling and dropout after development processing, and further it formed no core-set curl.

EXAMPLE 10

Similar to the sample of Example 5-A, the sample of Example 10-A was prepared as described below.

Both surfaces of a polyethylene 2,6-naphthalene dicarboxylate support of 90 μm thickness were subjected to a flame treatment. The flame treatment equipment used was one manufactured by KASUGA DENKI Co., and the treatment conditions were as follows: the distance between the top of the inner flame of the burner and the support, 2 cm; the mixture ratio of propane gas/air, 1/18 by volume; the flame treatment amount, 5 Kcal/m$^2$. Further, a hollow-type tube, inside of which passed cooling water, was used as a backup roll bearing the support at the time of the flame treatment, and the treatment was carried out at a constant temperature of 30° C. at all times. The same operation was repeated in the same manner as in Example 5-A, except for the above-described flame treatment, to prepare the sample of Example 10-A.

It was found that the present sample of Example 10-A, as well as the samples of Examples 5-A and 9-A, was an excellent photographic film hardly causing emulsion peeling and dropout after development processing, and it formed no core-set curl.

EXAMPLE 11

Similar to the sample of Example 5-A, the sample of Example 11-A was prepared as described below.

Both surfaces of a polyethylene 2,6-naphthalene dicarboxylate support of 90 μm thickness were subjected to a corona discharge treatment. After that, onto each of the two surfaces of the treated support, a subbing solution having the following composition was coated, as a subbing layer and as the first backing layer, so that the dried thickness of the coating layer would be 0.1 μm.

| | |
|---|---|
| Gelatin | 3 g |
| Distilled water | 250 cc |
| Sodium α-sulfo di-2-ethyl hexylsuccinate | 0.05 g |
| Folmaldehyde | 0.02 g |

The corona discharge treatment was performed using solid-state corona treatment equipment manufactured by Pillar Co. (Model 6KVA), whereby the support of width 30 cm was treated at the rate of 20 m/min. At this time, according to the reading value of an electric current and voltage, the support to be treated was treated at the rate of 0.375 kV•A•min/m$^2$. The discharge frequency at the treatment was 9.6 kHz, and the gap clearance between the electrode and the dielectric roll was 1.6 mm. The same operation was repeated in the same manner as in Example 5-A, except for the above-mentioned surface treatment for the support, to prepare the sample of Example 11-A.

It was found that the present sample of Example 11-A, as well as the samples of Examples 5-A, 9-A, and 10-A, was an excellent photographic film hardly causing emulsion peeling and dropout after development processing, and it formed no core-set curl.

EXAMPLE 12

A sample was prepared in the same manner as in Example 5-A, except that no surface treatment was applied to the polyethylene 2,6-naphthalene dicarboxylate support of 90 μm thickness. This sample was designated as the sample of Example 12-A.

In such a unique case as the present sample of Example 12-A, in which no surface treatment (i.e. UV, glow, flame, or corona treatment, as described above) was applied to the support, each of the photographic emulsion surface and the back surface could not achieve sufficient adhesion to the support, so that both the photographic-constituting layers on the same side on which a light-sensitive layer was coated, and the backing layers, were peeled off at the time of handling. Consequently it was confirmed that the sample of Example 12-A was not a preferable light-sensitive material.

EXAMPLE 13

The samples of Examples 1-A, 1-C to 1-H according to the present invention, and the sample of Example 1-B for comparison, each were slit into a photographic film of width 24 mm. After that, these photographic films each were encased into a sending-back-type cartridge, disclosed in JP-A No. 61123/1990. With respect to the cartridge for use in this example, the outside diameter was 20 mm, the inside diameter was 18 mm, and the spool diameter was 7 mm. The length of the encased photographic film was 1.4 m. When the edge part on the back surface of the film was observed using an optical microscope, after the reversal sending out from/rewinding into the cartridge had been repeated 200 times, emulsion peeling was found to have occurred in the case of the comparative sample. On the other hand, no emulsion peeling was found in the case of the samples according to the present invention in the conditions same to the comparative sample, because the samples were improved against emulsion peeling. Accordingly, incorporating the crosslinking agent for use in the present invention into the backing layer can provide an excellent light-sensitive material that is suitable for the sending-back-type cartridge system.

EXAMPLE 14

Samples were prepared in the exactly same manner as in Example 9-A, except that the composition for the fourth backing layer was completely replaced by the composition described below, and further the coating amount of the crosslinking agent to be added to the third backing layer was changed, as shown in Table 3. These samples were designated as the samples of Examples 14-A to 14-C.

Preparation of the dispersion undiluted solution

The following composition for the A Solution was heated at 90° C. to make a solution, and then the solution was added to the B Solution, followed by dispersion by means of a high-voltage homogenizer, to prepare a dispersion undiluted solution for use as a slipping layer.

| | |
|---|---|
| A Solution | |
| Compound (16-4) | 0.75 weight parts |
| Compound (18-3) | 0.75 weight parts |
| Xylene | 2.11 weight parts |
| Propyleneglycohol monomethylether | 0.08 weight parts |
| B Solution | |
| Cyclohexanone | 96.3 weight parts |

To 482 g of the above-described dispersion undiluted solution, the following binder, solvents, and the like were added, in order to make a coating solution.

| | |
|---|---|
| Hydroxypropyl cellulose (Trade name HPC-SL, manufactured by Nippon Soda Co. Ltd.) | 12.12 g |
| Isopropyl alcohol | 3243 g |
| Methanol | 114.55 g |
| Cyclohexanone | 144 g |
| $C_8F_{17}NC_3H_7(CH_2CH_2O)_p(CH_2)_4SO_3Na$ p: average 4 | 0.73 g |

-continued

| | |
|---|---|
| Polyester-modified silicon solution (Trade name BYK 310, manufactured by BYK Chemi Japan Co., Ltd; solid content, 25%) | 2.88 g |

The above-described coating solution, for use as a slipping layer, was coated in an amount of 10.4 cc/m$^2$.

It was found that the thus-formed samples of Examples 14-A to 14-C, containing a crosslinking agent for use in the present invention in a backing layer, were each photographic films having a transparent magnetic recording layer, in which films emulsion peeling was well prevented, to the same degree as the sample of Example 9-A, and the dropout after development processing was improved much more than the sample of Example 9-A. Consequently it is very preferable to incorporate a fluoro compound into a backing layer of the film, from the viewpoint of further improvement against dropout after development processing, and therefore a silver halide photographic light-sensitive material having an excellent transparent magnetic recording layer can be provided.

TABLE 3

| Sample No. | Used cross-linking agent | Coated amount (mg/m$^2$) | Evaluation of durability on emulsion peeling Part 1 | Part 2a | Part 2b | Evaluation of magnetic recording/reproduction after the development processing (number of dropout) | Remarks |
|---|---|---|---|---|---|---|---|
| Example 14A | Crosslinking agent 1 | 3 | ○ | ○ | ○ | ◎ | This invention |
| Example 14B | | 70 | ○ | ○ | ○ | ◎ | This invention |
| Example 14C | | 1000 | ○ | ○ | ○ | ◎ | This invention |

EXAMPLE 15

Samples were prepared in the same manner as in Example 1-A, except that the Crosslinking agent 1 (Millionate MR-400) was respectively replaced by each of Millionate MT, Millionate MR-100, Millionate MR-200, and Millionate MR-300 (all trade names, manufactured by Nippon Polyurethane Co., Ltd.) These samples were designated as the samples of Examples 15-A to 15-D, respectively. Further, samples were prepared in the same manner as Example 14-B, except that the Crosslinking agent 1 (Millionate 400) was respectively replaced by each of Millionate MT, Millionate MR-100, Millionate MR-200, and Millionate MR-300. These samples were designated as the samples of Examples 15-E to 15-H, respectively. It was found that these samples of Examples 15-A to 15-H, as well as the samples of Examples 1-A and 14-B, were photographic films that each had an excellent transparent magnetic recording layer, in which films the problems of both emulsion peeling and dropout after development processing were considerably improved.

EXAMPLE 16

A sample was prepared in the same manner as in Example 5-A, except that the crosslinking agent 1 was omitted in the third backing layer, and in place of that, the crosslinking agent 1 was further added to the fourth backing layer, in an amount of 3.0 g. This sample was designated as the sample of Example 16-A.

It was found that the thus-formed sample of Example 16-A, as well as the sample of Example 5-A, was a photographic film having an excellent transparent magnetic recording layer improved against both emulsion peeling and dropout after development processing.

EXAMPLE 17

A sample was prepared in the same manner as in Example 5-A, except that an additional layer having the following composition was coated between the second backing layer and the third backing layer, and the crosslinking agent 1 was omitted from the third backing layer:

| | |
|---|---|
| Closslinking agent 1 | 3.8 g |
| Methyl ethyl ketone | 248.1 g |
| Cyclohexanone | 248.1 g |

The coating was carried out according to a bar-coating method, and the coating amount was 10.4 cc/m$^2$. This sample was designated as the sample of Example 17-A.

It was found that the thus-formed sample of Example 17-A, as well as the sample of Example 5-A, was a photographic film having an excellent transparent magnetic recording layer improved against both emulsion peeling and dropout after development processing.

EXAMPLE 18

The same operation was repeated in the same manner as in Example 5-A, except that photographic emulsion layers were replaced by the same reversal color photographic emulsion layers of sample 101 of the Example 1 in JP-A No. 854/1990, and further development processing was conducted according to the processing method for a color reversal light-sensitive material shown in the Example 1 of JP-A No. 854/1990. As a result, it was found that, like the sample of Example 5-A, a photographic film having an excellent transparent magnetic recording layer improved against both emulsion peeling and dropout after development processing could be obtained.

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide photographic light-sensitive material that comprises at least one silver halide emulsion layer on a support, and at least one backing layer on the other side of the support, one of which backing layers is a transparent magnetic recording layer, wherein at least one of the backing layers contains a crosslinking agent represented by general formula (1) in the range of from 3 mg/m$^2$ to 1000 mg/M$^2$, and wherein the transparent magnetic recording layer contains abrasives that have Moh's hardness values of not less than 5; General formula (1)

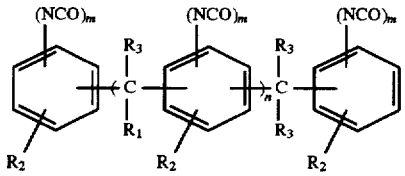

wherein n is a positive integer, including 0 (zero); m is an integer of 1 or 2; and $R_1$, $R_2$, and $R_3$ each represent a hydrogen atom, an alkyl group, or an aryl group;

wherein the photographic light-sensitive material contains at least one slipping agent having at least one of a hydroxyl group and an amino group..and the at least one slipping agent is dispersed with a dispersant selected from the group consisting of compounds (18-1) to (18-11):

$$n\text{-}C_{30}H_{61}O(CH_2CH_2O)_{10}H \quad (18\text{-}1)$$

$$n\text{-}C_{40}H_{81}O(CH_2CH_2O)_{15}H \quad (18\text{-}2)$$

$$n\text{-}C_{50}H_{101}O(CH_2CH_2O)_{16}H \quad (18\text{-}3)$$

$$n\text{-}C_{50}H_{101}O(CH_2CH_2O)_{30}H \quad (18\text{-}4)$$

$$n\text{-}C_{40}H_{81}O(CH_2CH_2O)_{10}H \quad (18\text{-}5)$$

$$n\text{-}C_{50}H_{101}(CH_2CH_2O)_{16}H \quad (18\text{-}6)$$

$$n\text{-}C_{50}H_{101}-(CH(CH_3)CH_2O)_3(CH_2CH_2O)_{16}H \quad (18\text{-}7)$$

$$n\text{-}C_{50}H_{101}-(CH_2CH(OH)CH_2O)_3-(CH(OH)CH_2O)_3-(CH_2CH_2O)_{15}H \quad (18\text{-}8)$$

$$n\text{-}C_{40}H_{81}OCOCH_2CH_2COO(CH_2CH_2O)_{16}H \quad (18\text{-}9)$$

$$n\text{-}C_{50}H_{101}OCOCH=CHCOO(CH_2CH_2O)_{16}H \quad (18\text{-}10)$$

$$n\text{-}C_{50}H_{101}OCOCH_2CH_2COO-(CH_2CH(OH)CH_2O)_3-(CH_2CH_2O)_{15}H. \quad (18\text{-}11)$$

2. The silver halide photographic light-sensitive material as claimed in claim 1, wherein the said backing layer contains at least one of tertiary amines, metal salts, and diaza-bicyclo-undecene (DBU).

3. The silver halide photographic light-sensitive material as claimed in claim 1, wherein a binder that constitutes the said magnetic recording layer is a cellulose ester.

4. The silver halide photographic light-sensitive material as claimed in claim 3, wherein the said cellulose ester is diacetyl cellulose or nitrocellulose.

5. The silver halide photographic light-sensitive material as claimed in claim 1, wherein magnetic grains incorporated in the magnetic recording layer are a ferromagnetic iron oxide fine powder, a Co-doped ferromagnetic iron oxide fine powder, a Co-coated ferromagnetic iron oxide fine powder, a ferromagnetic chromium dioxide fine powder, a ferromagnetic metal fine powder, a ferromagnetic alloy fine powder, barium ferrite, magnetite, Co-doped magnetite, or Co-coated magnetite.

6. The silver halide photographic light-sensitive material as claimed in claim 1, wherein the said support is a polyester support whose Tg is in the range of from 50° C. to 200° C., and the said polyester support is previously subjected to a heat treatment at the temperature of from its Tg to (Tg-50° C.).

7. The silver halide photographic light-sensitive material as claimed in claim 6, wherein the said support is polyethylene-2,6-naphthalene dicarboxylate.

8. The silver halide photographic light-sensitive material as claimed in claim 1, wherein the said support is subjected to a surface treatment by at least one of a UV treatment, a glow discharge treatment, a flame treatment, and a corona treatment.

9. The silver halide photographic light-sensitive material as claimed in claim 1, wherein at least one of the backing layers contains an antistatic agent (an electrically conductive metal oxide and/or an ionic polymer (electric resistivity $10^{12}$•cmΩ, or less, 25° C./10% RH)), and/or a fluoro compound, and/or a slipping agent (kinematic friction coefficiency 0.25 or less), and/or a matting agent (grain size from 0.1 to 1.5 μm).

10. The silver halide photographic light-sensitive material as claimed in claim 1, wherein the said crosslinking agent represented by general formula (1) is contained in the said magnetic recording layer and/or a adjacent layer thereto.

11. The silver halide photographic light-sensitive material as claimed in claim 1, wherein the transparent magnetic recording layer has the transparency from 0 to 0.5 in terms of transmission density through a blue filter.

12. The silver halide photographic light-sensitive material as claimed in claim 1, wherein a water-soluble binder exits on the surface of the side having coated thereon a transparent magnetic recording layer.

13. The silver halide photographic light-sensitive material as claimed in claim 12, wherein the water-soluble binder is a cellulose derivative.

14. The silver halide photographic light-sensitive material as claimed in claim 1, wherein the at least one slipping agent is selected from the group consisting of Compounds (16-2), (16-3), (16-4), (16-5), (16-7), (16-8), (16-9), (16-11), (17-1), (17-4), (17-7), (17-8) and (17-11):

$$C_{17}H_{35}COOCH_2CH(OH)C_{12}H_{25} \quad (16\text{-}2)$$

$$C_9H_{19}C(OH)(C_9H_{19})CH_2COOC_{25}H_{51} \quad (16\text{-}3)$$

$$C_6H_{13}CH(OH)(CH_2)_{10}COOC_{40}H_{81} \quad (16\text{-}4)$$

$$C_{14}H_{29}CH(NH_2)COO(CH_2)_nCH(CH_3)(CH_2)_m-CH_3 \quad (n+m=15) \quad (16\text{-}5)$$

$$HOCH_2(CH_2)_6CH(OH)CH(OH)(CH_2)_4COO-C_{50}H_{101} \quad (16\text{-}7)$$

$$C_{17}H_{33}COO(CH_2)_{16}OH \quad (16\text{-}8)$$

$$CH_3(CH_2)_2CH(OH)(CH_2)_6CONHC_{21}H_{42} \quad (16\text{-}9)$$

$$C_{27}H_{55}COOCH_2CH(OH)CH_2OH \quad (16\text{-}11)$$

$$C_{14}H_{29}CHCOO(CH_2)_5OCOCH(OH)C_{14}H_{29} \quad (17\text{-}1)$$

$$C_9H_{19}C(OH)(C_9H_{19})CH_2COO(CH_2)_{15}CONH-C_{10}H_{21} \quad (17\text{-}4)$$

$$C_6H_{13}CH(OH)(CH_2)_{10}COO(CH_2)_8OCO-(CH_2)_{10}CH(OH)C_6H_{13} \quad (17\text{-}7)$$

$$C_{15}H_{31}COOCH_2CH(OH)CH_2OCOC_{15}H_{31}C_6H_{17}NHCO(CH_2)_{10}COO(CH_2)_{15}OH \quad (17\text{-}8)$$

$$HOCH_2CH(OH)CH_2OC(CH_2)_3CH(C_2H_5)-(CH_2)_9COOC_{50}H_{101}. \quad (17\text{-}11)$$

15. The silver halide photographic light-sensitive material as claimed in claim 1, wherein the silver halide light-sensitive material contains the slipping agent in a surface layer in an amount of from 0.001 to 0.1 g/m$^2$.

16. A photographic product that comprises a combination of a patrone system for a silver halide photographic light-sensitive material and a silver halide photographic light-sensitive material, the patrone system being capable of sending outward the tip of a film wound on a spool from a mouth-piece of the patrone from which the film is pulled out, by rotating the spool toward the film-sending direction, which spool is provided inside of the patrone in a freely rotative manner; and the silver halide photographic light-sensitive material comprising at least one silver halide emulsion layer on a support, and at least one backing layer on the other side of the support, one of which backing layers is a transparent magnetic recording layer, wherein at least one of the backing layers contains a crosslinking agent represented by general formula (1) in the range of from 3 mg/m$^2$ to 1000 mg/m$^2$, and wherein the transparent magnetic recording layer contains abrasives that have Moh's hardness values of not less than 5; General formula (1)

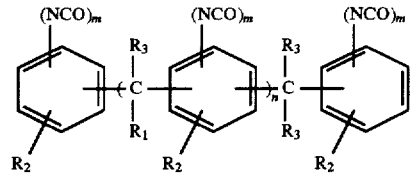

wherein n is a positive integer, including 0 (zero); m is an integer of 1 or 2; and $R_1$, $R_2$, and $R_3$ each represent a hydrogen atom, an alkyl group, or an aryl group;

wherein the photographic light-sensitive material contains at least one slipping agent having at least one of a hydroxyl group and an amino group, and the at least one slipping agent is dispersed with a dispersant selected from the group consisting of compounds (18-1) to (18-11):

$$n\text{-}C_{30}H_{61}O(CH_2CH_2O)_{10}H \quad (18\text{-}1)$$

$$n\text{-}C_{40}H_{81}O(CH_2CH_2O)_{15}H \quad (18\text{-}2)$$

$$n\text{-}C_{50}H_{101}O(CH_2CH_2O)_{16}H \quad (18\text{-}3)$$

$$n\text{-}C_{50}H_{101}O(CH_2CH_2O)_{30}H \quad (18\text{-}4)$$

$$n\text{-}C_{40}H_{81}O(CH_2CH_2O)_{10}H \quad (18\text{-}5)$$

$$n\text{-}C_{50}H_{101}(CH_2CH_2O)_{16}H \quad (18\text{-}6)$$

$$n\text{-}C_{50}H_{101}-(CH(CH_3)CH_2O)_3(CH_2CH_2O)_{16}H \quad (18\text{-}7)$$

$$n\text{-}C_{50}H_{101}-(CH_2CH(OH)CH_2O)_3-(CH(OH)CH_2O)_3-(CH_2CH_2O)_{15}H \quad (18\text{-}8)$$

$$n\text{-}C_{40}H_{81}OCOCH_2CH_2COO(CH_2CH_2O)_{16}H \quad (18\text{-}9)$$

$$n\text{-}C_{50}H_{101}OCOCH=CHCOO(CH_2CH_2O)_{16}H \quad (18\text{-}10)$$

$$n\text{-}C_{50}H_{101}OCOCH_2CH_2COO-(CH_2CH(OH)CH_2O)_3-(CH_2CH_2O)_{15}H. \quad (18\text{-}11)$$

* * * * *